US008393280B2

(12) United States Patent
Bartel

(10) Patent No.: US 8,393,280 B2
(45) Date of Patent: Mar. 12, 2013

(54) LOCKABLE ENCLOSURE

(76) Inventor: David W. Bartel, Warsaw, MO (US)

( * ) Notice: Subject to any disclaimer, the term of this patent is extended or adjusted under 35 U.S.C. 154(b) by 0 days.

(21) Appl. No.: 13/008,527

(22) Filed: Jan. 18, 2011

(65) Prior Publication Data

US 2011/0174200 A1 Jul. 21, 2011

Related U.S. Application Data

(60) Provisional application No. 61/295,699, filed on Jan. 16, 2010.

(51) Int. Cl.
*E05G 1/00* (2006.01)

(52) U.S. Cl. ..... 109/48; 109/59 T; 109/70; 109/71; 109/45; 109/58; 109/73; 109/64; 109/50; 70/DIG. 19; 70/DIG. 18

(58) Field of Classification Search ..... 109/22, 109/59 T, 71, 70, 45, 58, 73, 64, 50, 59 R, 109/48; 70/DIG. 18, DIG. 19; 49/208, 209, 49/246, 261; 211/196, 197, 163, 78, 70; 312/125, 135, 238, 305; 220/345.1, 345.2, 220/351, 811, 812, 815
See application file for complete search history.

(56) References Cited

U.S. PATENT DOCUMENTS

| | | | | |
|---|---|---|---|---|
| 195,219 | A | 9/1877 | Kingham | |
| 799,233 | A | 9/1905 | Hubbell | |
| 895,581 | A | 8/1908 | Nygreen | |
| 941,940 | A | 11/1909 | McCormick | |
| 1,283,866 | A | 11/1918 | Nanni | |
| 1,325,197 | A | 2/1919 | Gregorovius | |
| 1,570,882 | A | 1/1926 | Ellison | |
| 1,749,203 | A * | 3/1930 | Wolters et al. | 109/59 R |
| 1,842,531 | A | 1/1932 | Mariotti | |
| 1,873,522 | A | 8/1932 | Abbott et al. | |
| 1,874,562 | A | 8/1932 | Mariotti | |
| 1,924,365 | A | 8/1933 | Mariotti | |
| 1,954,668 | A | 4/1934 | Ernst | |
| 2,463,569 | A | 3/1949 | Halter | |
| 2,686,007 | A | 8/1954 | Hurtig et al. | |
| 2,819,114 | A | 1/1958 | Lake | |
| 3,479,104 | A | 11/1969 | Kobryner | |
| 3,748,005 | A | 7/1973 | Chovanec et al. | |
| 4,099,808 | A * | 7/1978 | Oakley et al. | 109/50 |
| 4,244,302 | A * | 1/1981 | Stine | 109/59 T |
| 4,478,350 | A | 10/1984 | Ohlsson | |
| 4,534,192 | A * | 8/1985 | Harshbarger et al. | 109/59 R |
| 4,545,630 | A * | 10/1985 | Izumi et al. | 312/285 |
| 4,548,353 | A | 10/1985 | Howard et al. | |
| 4,643,107 | A | 2/1987 | Gunn et al. | |
| 4,852,503 | A | 8/1989 | Lichter | |
| 5,094,483 | A * | 3/1992 | James | 109/59 R |
| 5,317,888 | A | 6/1994 | Towns | |
| 5,403,079 | A | 4/1995 | Fetisoff | |
| 5,722,332 | A | 3/1998 | Fumanelli | |
| 5,778,708 | A * | 7/1998 | Crosby et al. | 109/59 T |
| 6,293,207 | B1 * | 9/2001 | Do | 109/59 R |
| 6,523,917 | B2 | 2/2003 | Twellmann | |

(Continued)

FOREIGN PATENT DOCUMENTS

DE 20002313 7/2001

*Primary Examiner* — Lloyd Gall
*Assistant Examiner* — David E Sosnowski
(74) *Attorney, Agent, or Firm* — Hovey Williams LLP

(57) ABSTRACT

A safe having a support assembly disposed in the interior of the safe. The door of the safe is coupled to the support assembly and is easily shiftable between a closed position wherein the door is received in an opening of the safe and an open position wherein the door is removed from the opening in the safe and disposed in the interior of the safe.

25 Claims, 34 Drawing Sheets

U.S. PATENT DOCUMENTS 6,865,993 B2 3/2005 Bartel et al.
7,096,801 B2 8/2006 Bartel et al.
7,516,709 B2 4/2009 Bartel et al.
7,559,428 B2 * 7/2009 Matzick ..... 211/64
2001/0013743 A1 8/2001 Twellmann
2008/0229983 A1 9/2008 Pendleton
2009/0324444 A1 * 12/2009 Stratmann ..... 49/324
2011/0174199 A1 * 7/2011 Pendleton et al. ..... 109/59 R

* cited by examiner

LOCKABLE ENCLOSURE

CROSS-REFERENCE TO RELATED APPLICATIONS

This application claims priority to U.S. Provisional Application Ser. No. 61/295,699, filed Jan. 16, 2010, the disclosure of which is incorporated herein by reference in its entirety to the extent it does not contradict statements herein.

BACKGROUND OF THE INVENTION

1. Field of the Invention

This invention relates generally to lockable enclosures having doors that are shiftable between an open position in which access to the interior of the enclosure is permitted and a closed position in which the door blocks access to the interior of the enclosure. In another aspect, the present invention relates to lockable safes for securely storing valuable items. In yet another aspect, the invention relates to gun safes for securely storing firearms, ammunition, and other gun-related valuables.

2. Discussion of Prior Art

Gun safes have been used for years and are typically employed to safely and securely store firearms in the home of the owner. Conventional gun safes are generally box-shaped and include a lockable, outwardly swinging door for permitting and preventing access to the interior of the safe. The interior of the safe typically includes a rack for supporting a single row of guns in a generally upright position.

Conventional gun safes have a number of drawbacks. For example, the box-like shape and outwardly swinging door gives the safe a rather bulky configuration. Because safes are typically located in the home of the gun owner, it may be desired to place the gun safe in a small-isolated portion of the home, such as a closet. However, conventional gun safes, with outwardly swinging doors, can be too bulky to be placed in a closet without consuming an excessive amount of space.

A further disadvantage of many conventional gun safes is that the outwardly swinging door of the gun safe is coupled to the side wall of the safe by an external hinge. Such an external hinge is undesirable because a thief can gain access to the interior of the safe by simply destroying the external hinge and removing the door.

A still further disadvantage of conventional gun safes is that the arrangement of the guns in the interior space of the safe does not optimize the number of guns which can be stored and readily accessed therein.

SUMMARY OF THE INVENTION

In accordance with one embodiment of the present invention, there is provided a secure enclosure that includes a housing, a door, a door locking system and a door shifting system. The door is coupled to the housing and shiftable between a closed position and an open position. The door locking system is configured to selectively lock and unlock the door in the closed position. The door shifting system is configured to shift the door into and out of the closed position. The door shifting system comprises a rotating member configured to be actuated from outside the enclosure. The rotating member is operatively coupled to the door shifting system and the door locking system in a manner such that rotation of the rotating member in one direction has the dual effect of unlocking the locking system and shifting the door out of the closed position.

In accordance with another embodiment of the present invention, there is provided a safe that includes a substantially cylindrical sidewall, a door having a radius of curvature corresponding to the curvature of the sidewall, and an automatic mechanical actuator for shifting the door relative to the housing.

In accordance with still another embodiment of the present invention, there is provided a method of operating a secure enclosure that has a housing and a door for selecting permitting access to the interior of the housing. The method includes the steps of: (a) turning a rotating member in a first direction to thereby unlock the door and translate the door relative to the housing; (b) rotating the door relative to the housing; and (c) turning the rotating member in a second direction opposite the first direction to thereby translate the door relative to the housing and lock the door relative to the housing.

Certain embodiments of the present invention may provide one or more of the following advantageous features:

(a) A safe having a more compact configuration than conventional safes.
(b) A safe having a door that can be opened with one continuous motion and does not swing outwardly when opened.
(c) A safe having an opening mechanism that is flush with the surface of the safe.
(d) A safe with a more secure locking mechanism.
(e) A safe that has no external hinges.
(f) A safe that can be controlled automatically and/or remotely.
(g) A gun safe that optimizes the number of guns that can be stored in the interior volume of the safe while still providing easy access to all of the guns therein.

Other aspects and advantages of the present invention will be apparent from the following detailed description of the preferred embodiments and the accompanying drawing figures.

BRIEF DESCRIPTION OF THE DRAWING FIGURES

The present invention is described here below with reference to the following drawing figures, wherein.

Figure 27A:
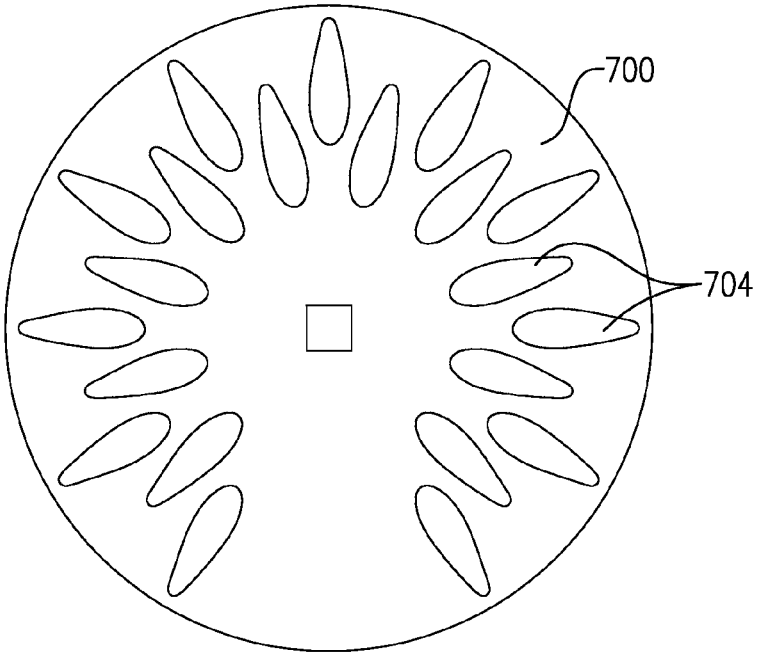
Figure 27B:
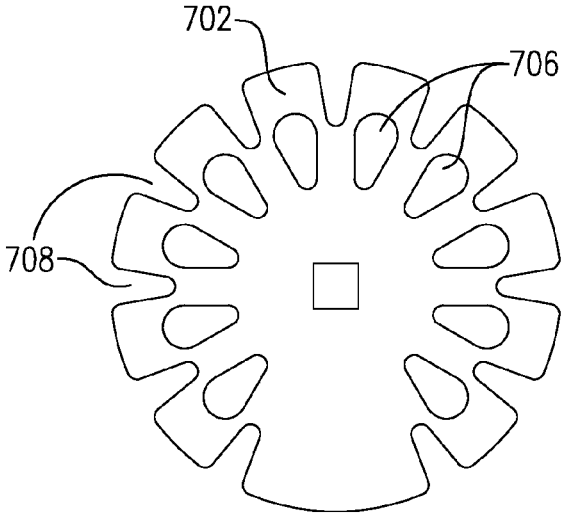
Figure 27C:
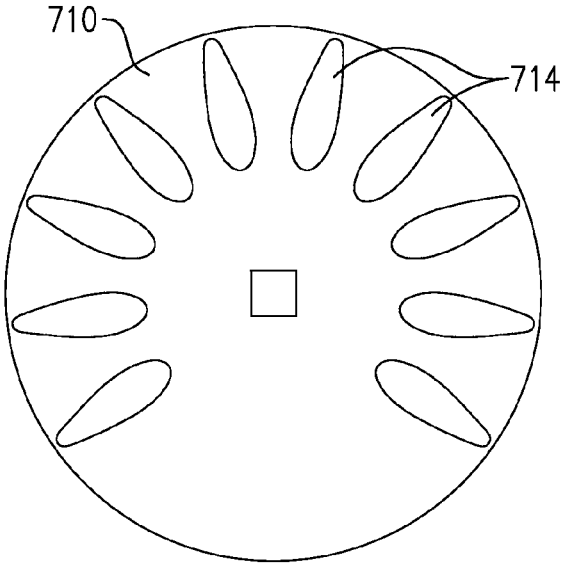
Figure 27D:
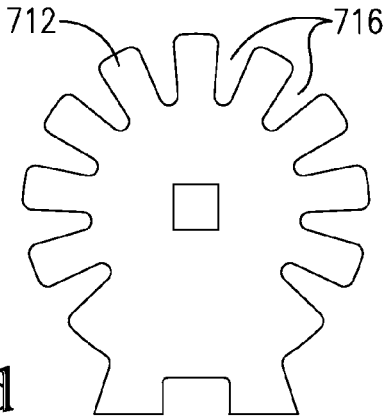
Figure 28:
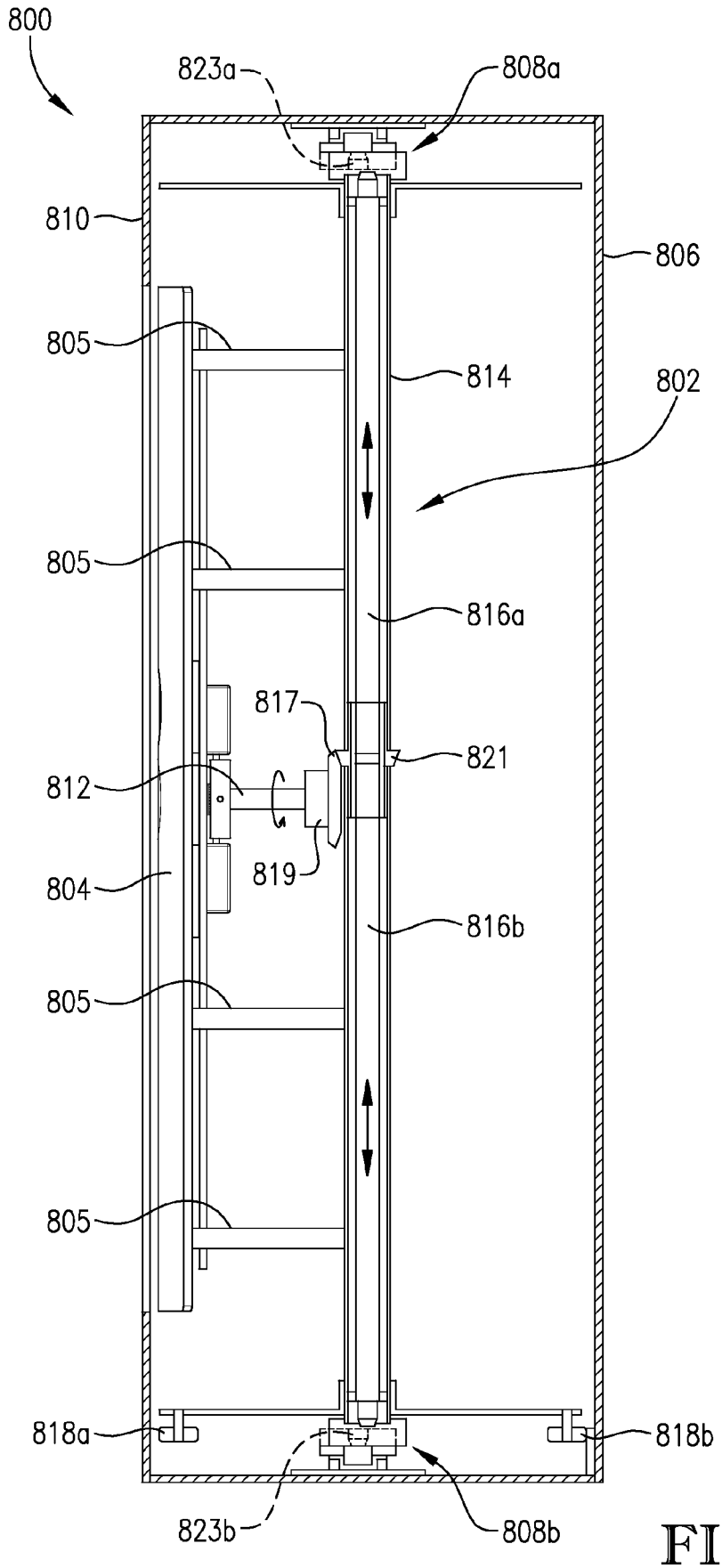
Figure 29:
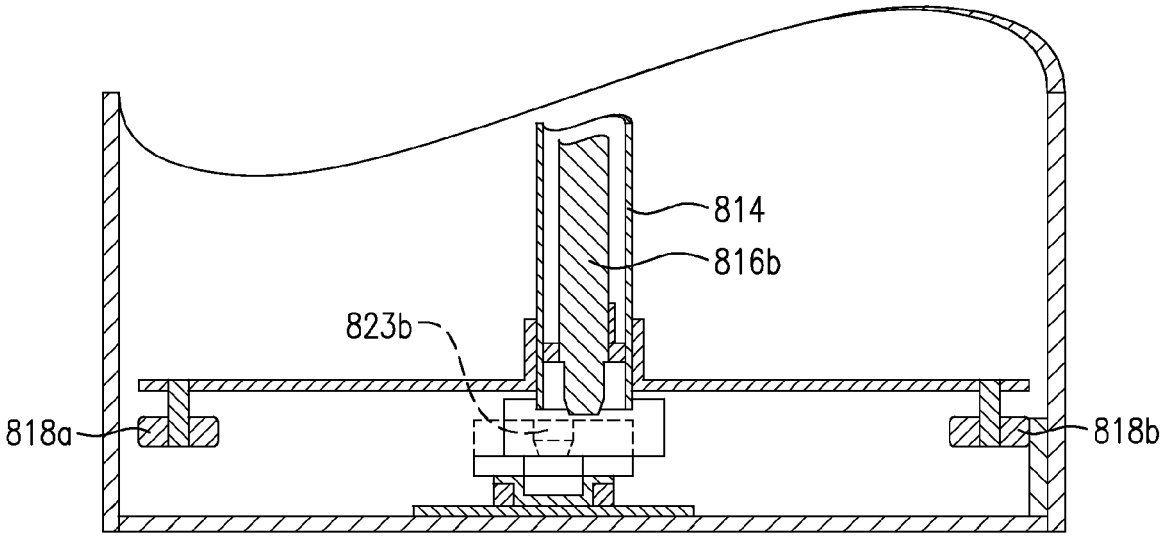
Figure 30:
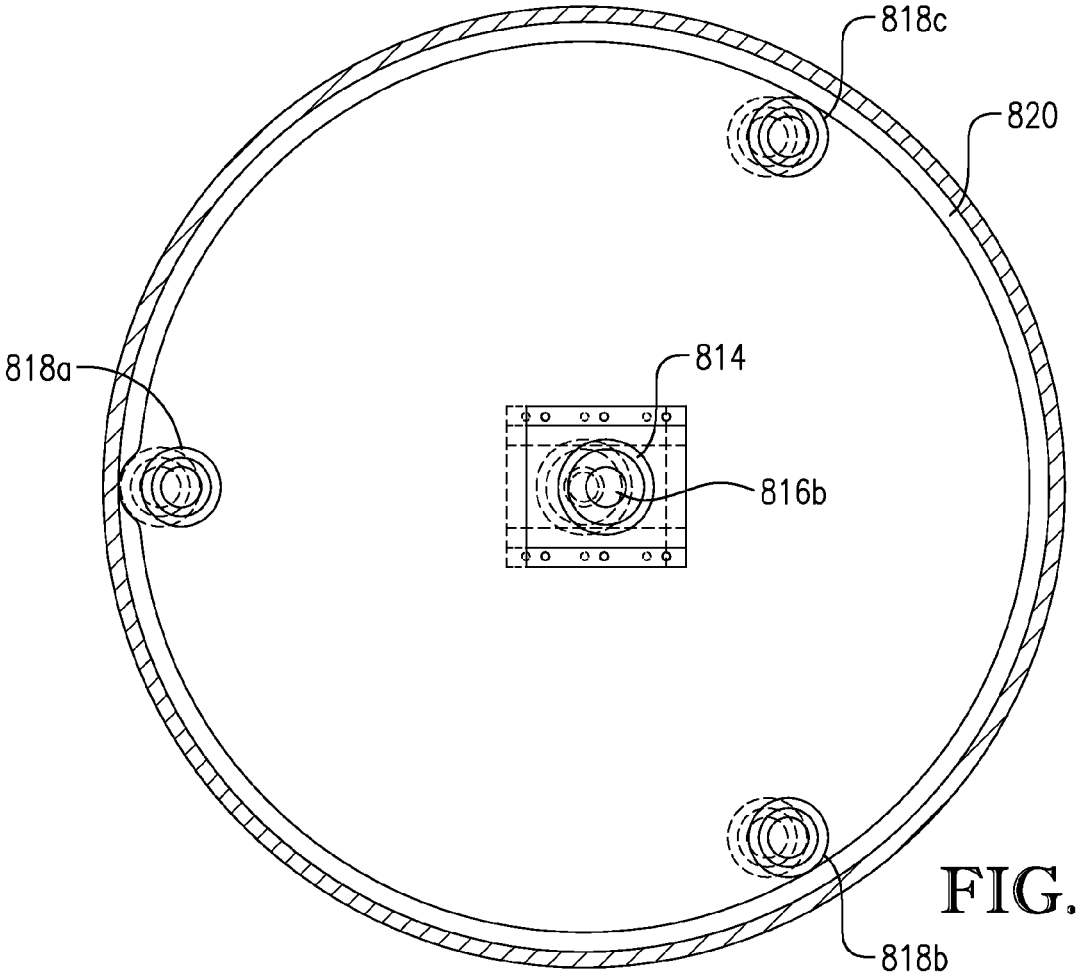
Figure 31:
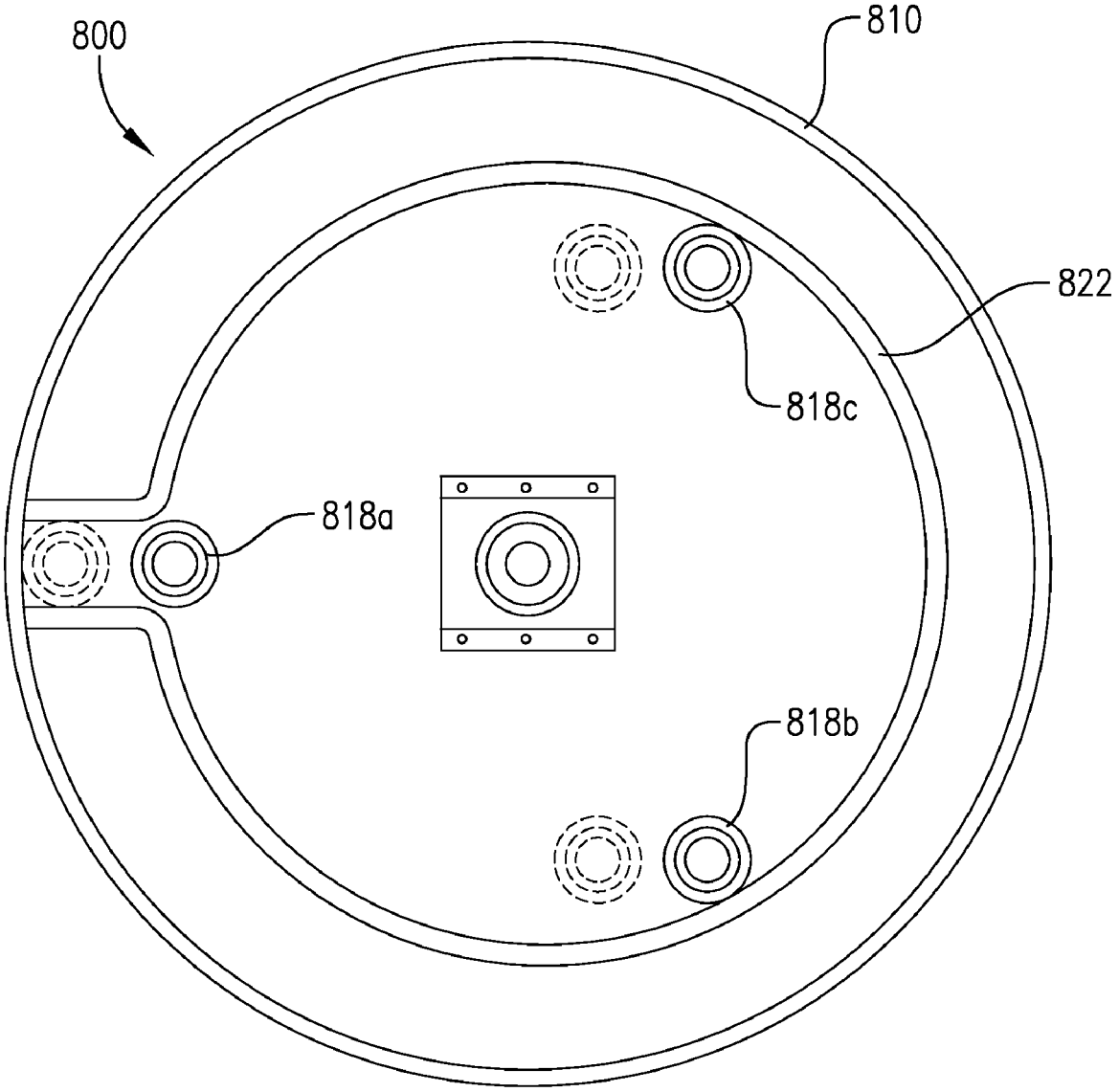
Figure 32:
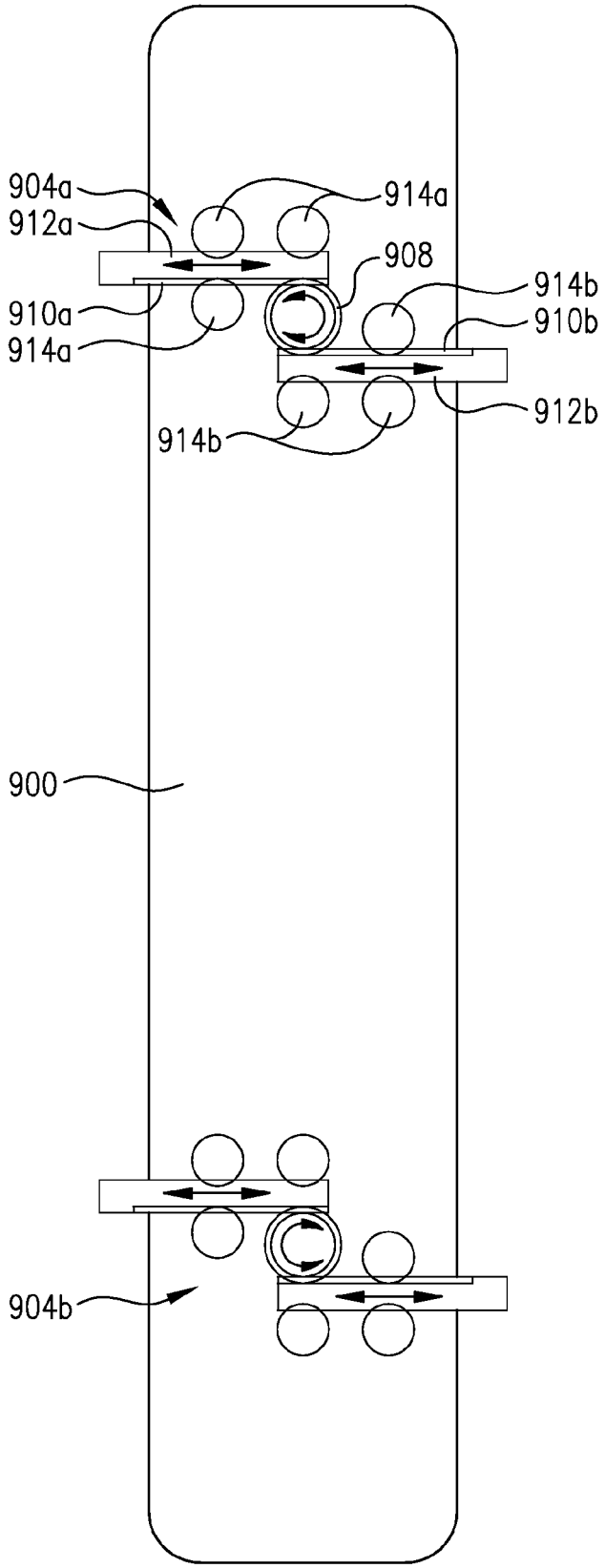
Figure 33:
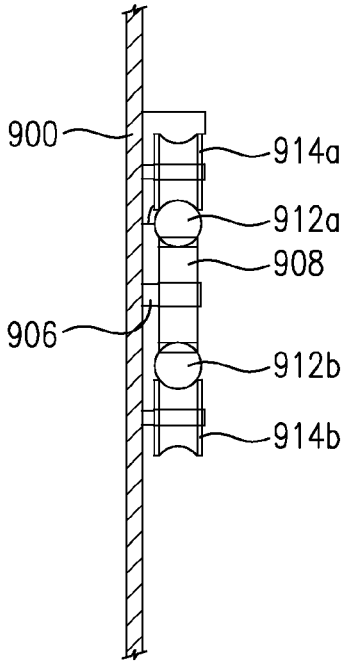
Figure 34:
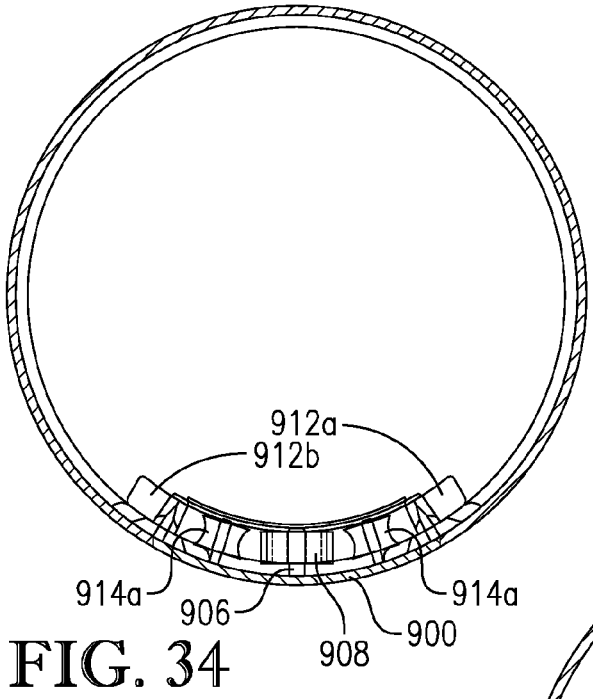
Figure 35:
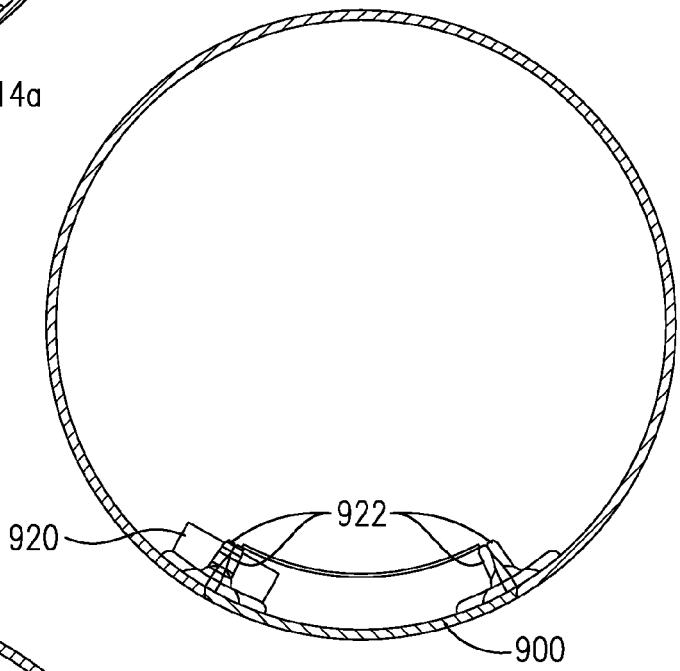
Figure 36:
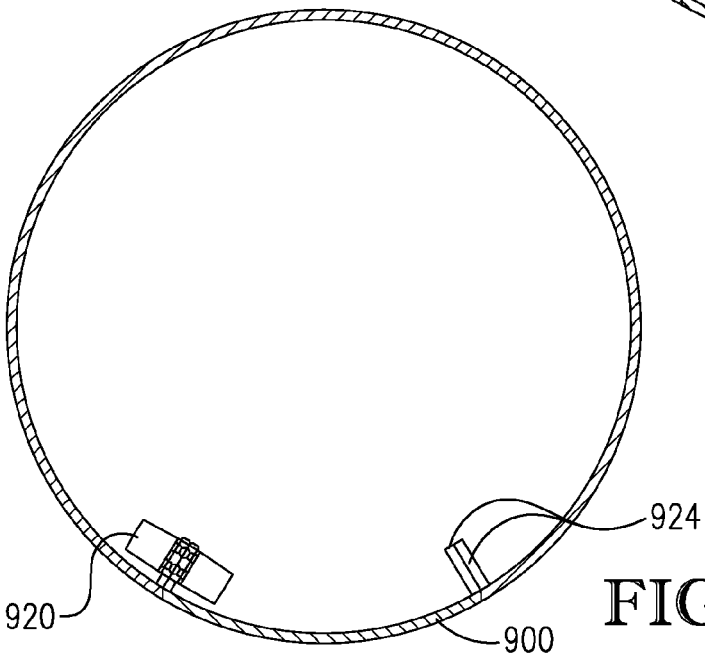
Figure 37:
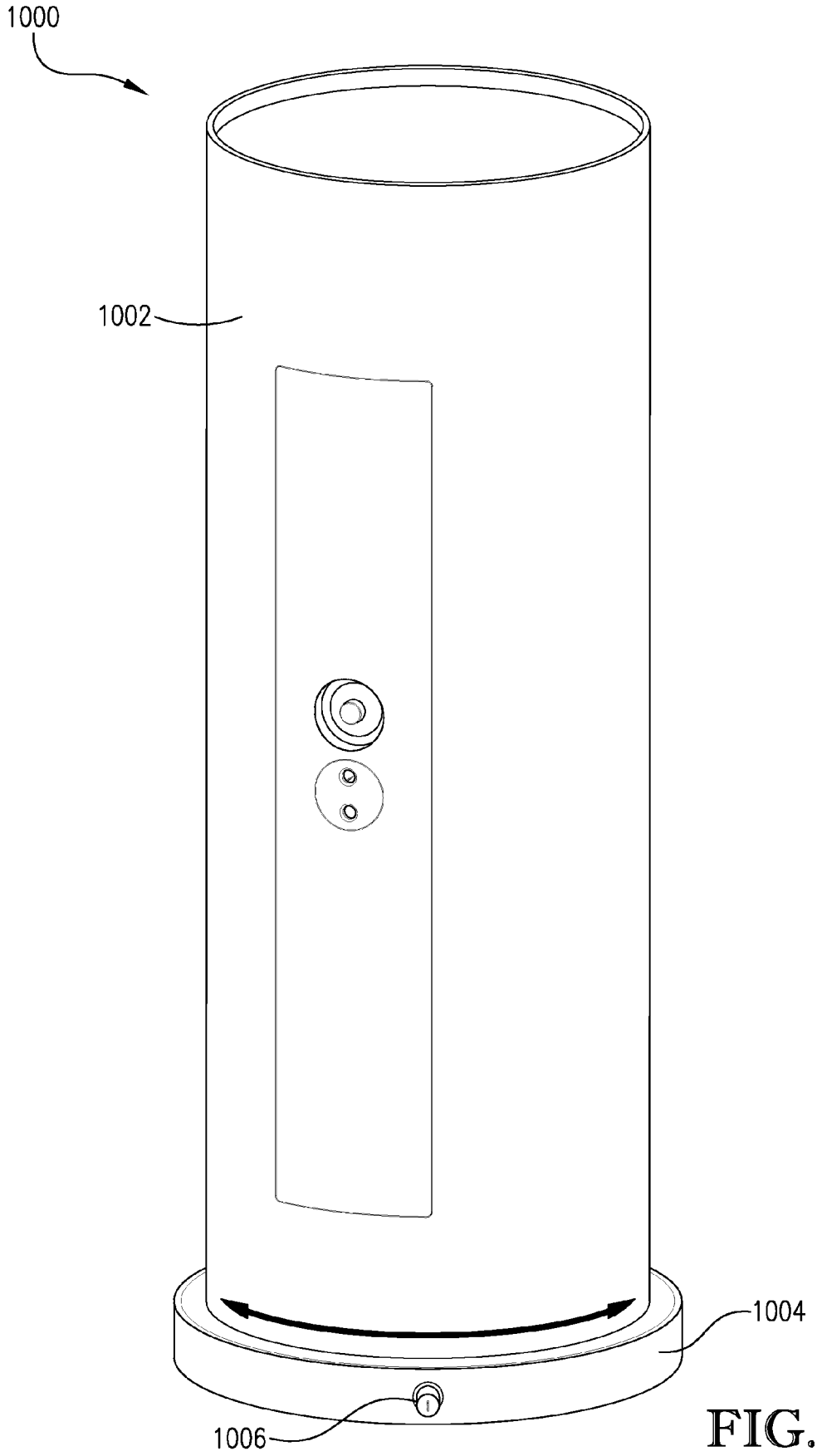
Figure 38:
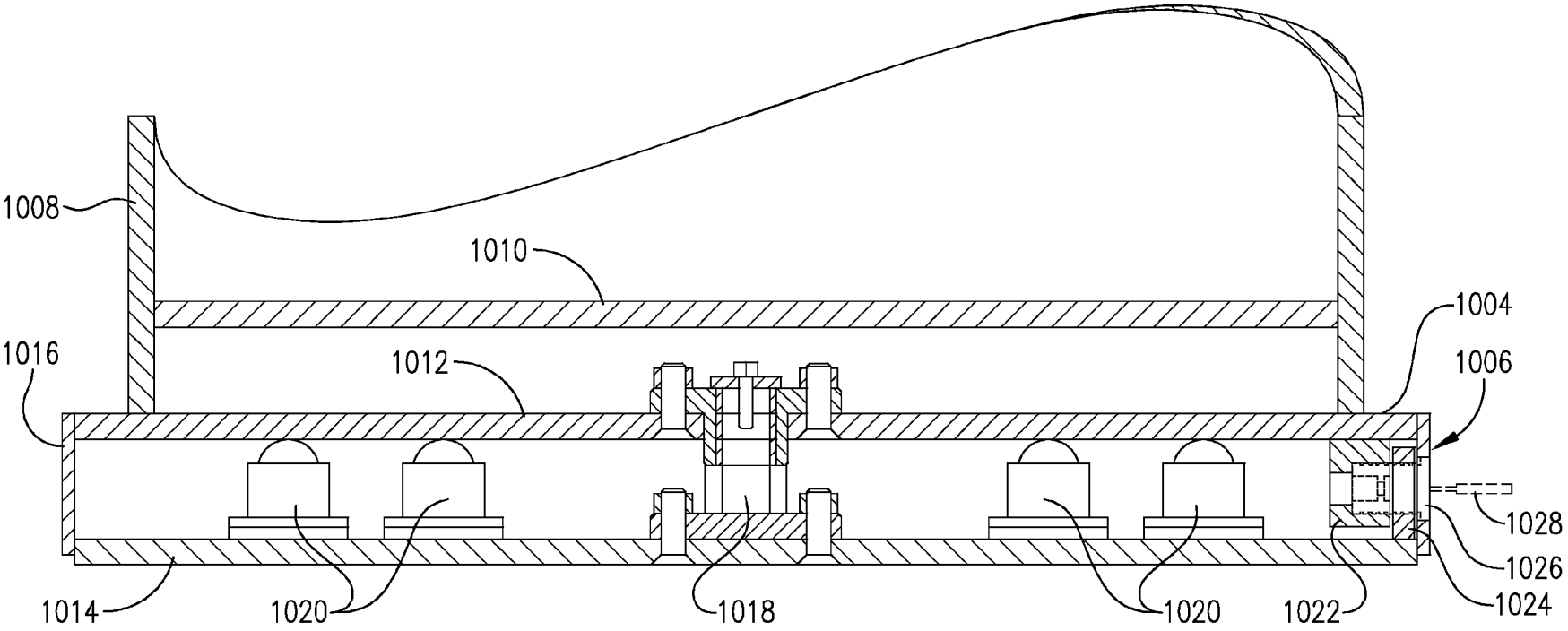
Figure 39B:
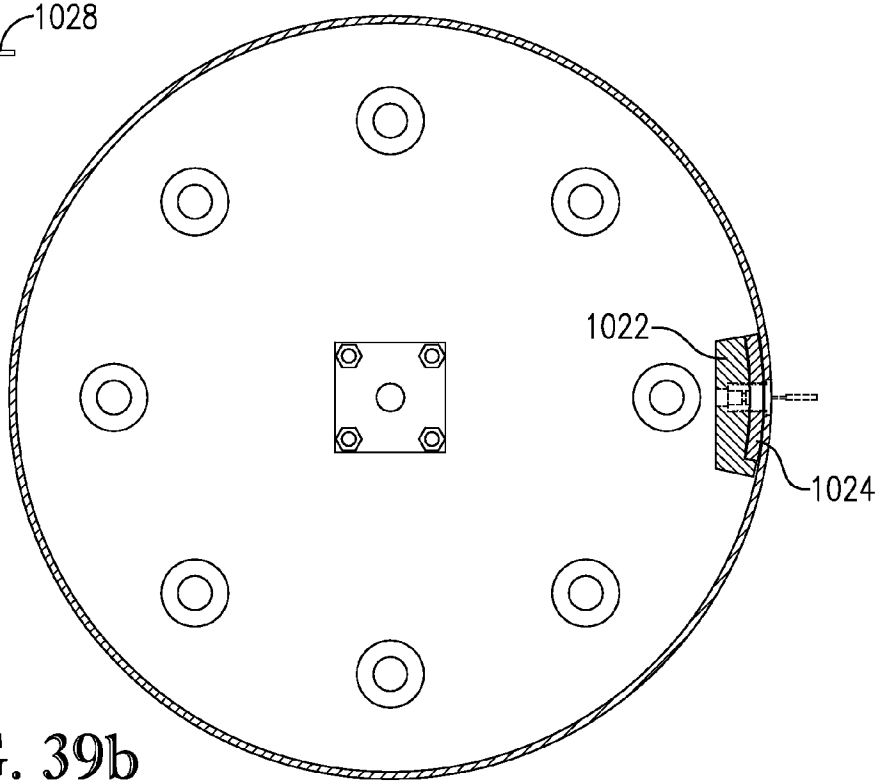
Figure 39A:
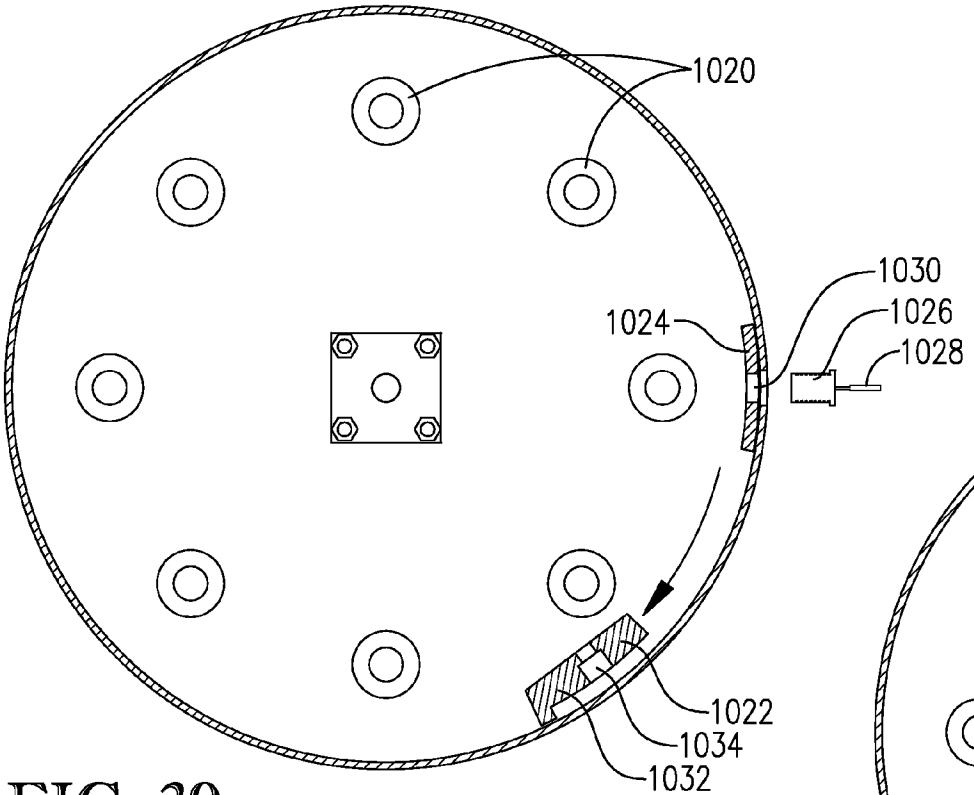
Figure 40:
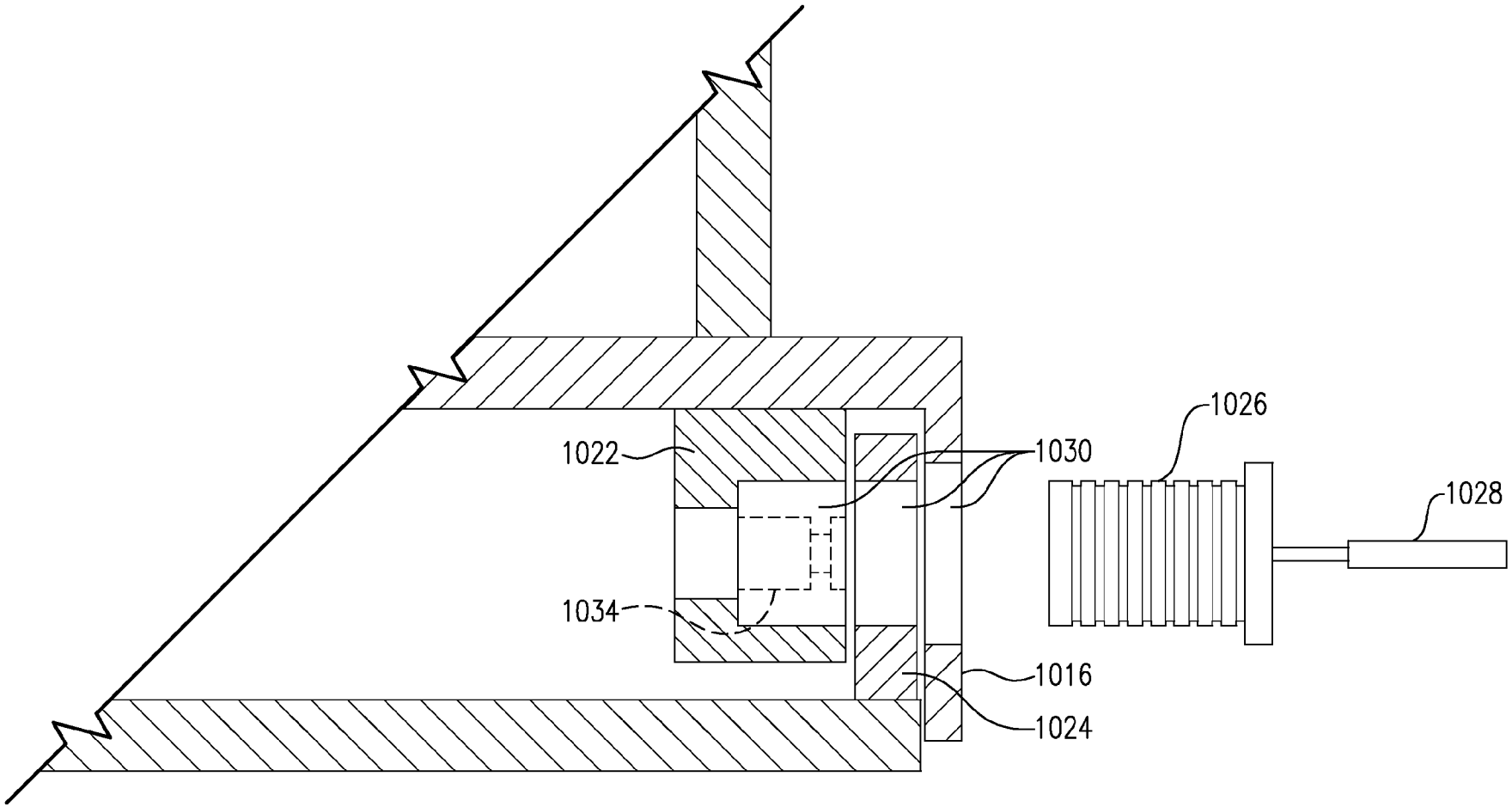

FIG. 27*a* is a top view of a gun supporting base for supporting the butt ends of guns in a safe configured to hold 21 long guns;

FIG. 27*b* is a top view of a gun supporting base for supporting the barrels of guns in a safe configured to hold 21 long guns;

FIG. 27*c* is a top view of a gun supporting base for supporting the butt ends of guns in a safe configured to hold 10 long guns;

FIG. 27*d* is a top view of a gun supporting base for supporting the barrels of guns in a safe configured to hold 10 long guns;

FIG. 28 is a sectional side view of a safe having in internal gun supporting assembly that is rigidly coupled to the door and slides inwardly and rotates with the door in order to access items in the safe;

FIG. 29 is an enlarged view of the bottom portion of the safe depicted in FIG. 28, particularly illustrating how the gun supporting base and upright support member slide inwardly when the door is opened;

FIG. 30 is a sectional top view showing the movement of the guide wheels along a guide curb on the inside of the safe when the safe is opened and closed;

FIG. 31 is a sectional top view showing the movement of the guide wheels along an alternatively configured guide curb when the safe is opened and closed;

FIG. 32 shows an alternative door configuration from the inside of the safe, where the door includes internal hinges and internal locking mechanisms to enhance the security of the safe, particularly illustrating the components of the internal locking mechanisms;

FIG. 33 is an enlarged side view of the components of the internal locking mechanisms of FIG. 32;

FIG. 34 is a sectional top view showing the components of the internal locking mechanisms of FIG. 32;

FIG. 35 is a sectional top view of a safe having internal hinges that allow the door to swing outwardly;

FIG. 36 is a sectional top view of a safe showing an alternative configuration of internal hinges that allow the door to swing outwardly;

FIG. 37 is an isometric view of the gun safe with a lockable base upon which the safe can be rotated and locked to hinder access to the door of the safe;

FIG. 38 is an enlarged sectional side view of the bottom of the safe resting on a base that allows for rotation of the base, where rotation of the safe on the base can be prevented using a locking mechanism;

FIG. 39*a* is sectional top view of the rotation base where the base is unlocked and rotated out of its home position;

FIG. 39*b* is a sectional top view of the rotation base in its home position where it is aligned for locking; and FIG. 40 is an enlarged sectional side view of the locking mechanism, particularly illustrating the individual components of the locking system.

DETAILED DESCRIPTION OF THE PREFERRED EMBODIMENTS

Figure 1:
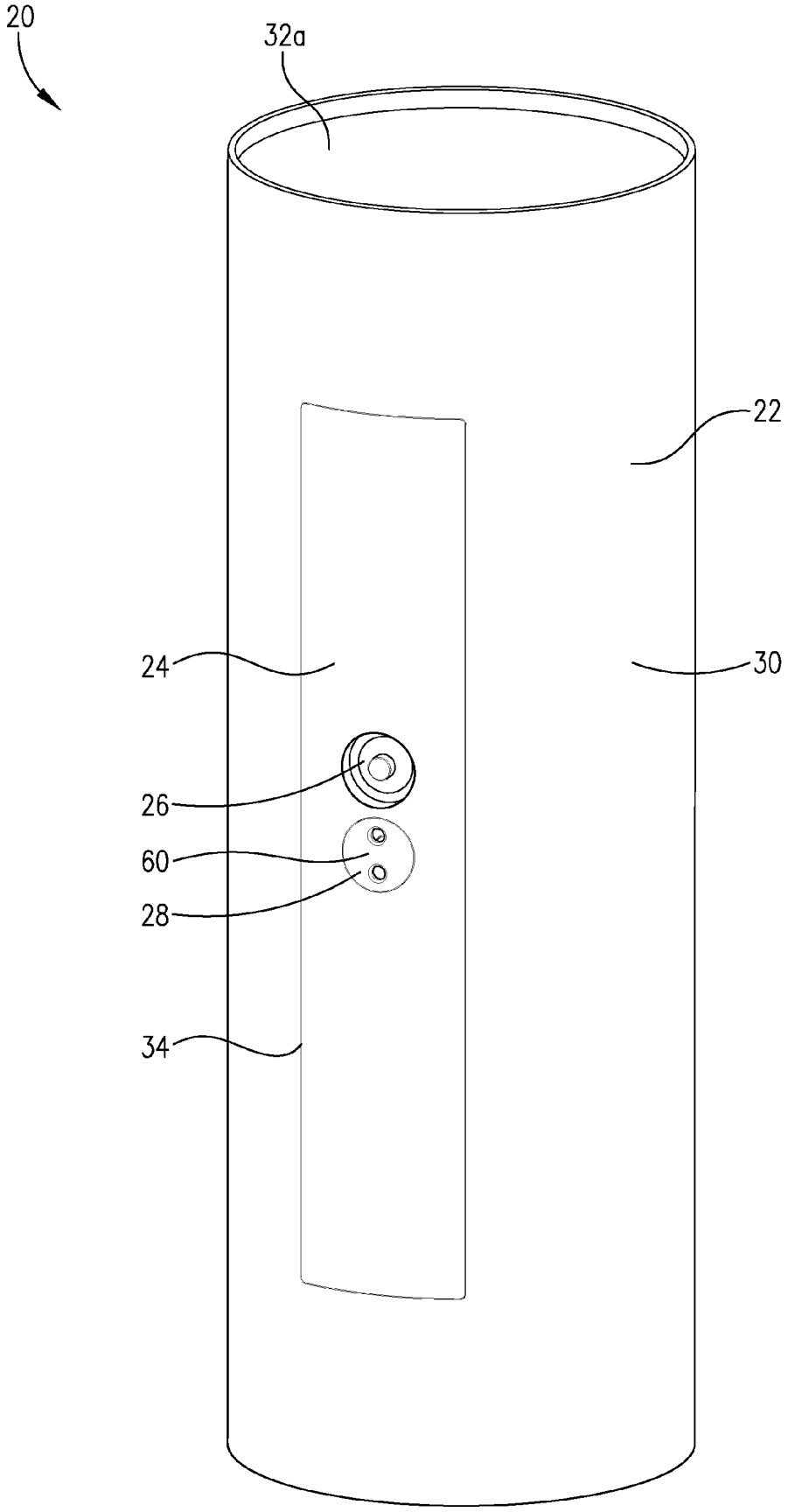
FIG. 1 is an isometric view of a gun safe constructed in accordance with the principles of the present invention.

Referring initially to FIG. 1, a gun safe 20 is illustrated as generally comprising a housing 22, a door 24, a lock assembly 26, and a door retraction assembly 28. Housing 22 generally includes a side wall 30 and a pair of end walls 32 coupled to side wall 30 at opposite ends of housing 22. Side wall 30 defines an opening 34 for providing access to the interior of gun safe 20. Door 24 is shiftable between a closed position (shown in FIG. 1) wherein door 24 is at least partly received in opening 34 and blocks access to the interior of safe 20 and an open position wherein door 24 is received in the interior of gun safe 20 and permits access to the interior of gun safe 20 through opening 34. Lock assembly 26 and door retraction assembly 28 are coupled to door 24. Lock assembly 26 is operable to selectively lock and unlock door 24 when door 24 is in the closed position. Door retraction assembly 28 is operable to shift door 24 between the closed position wherein door 24 is at least partly received in opening 34 and a retracted position wherein door 24 is retracted inward, away from opening 34.

Figure 2:
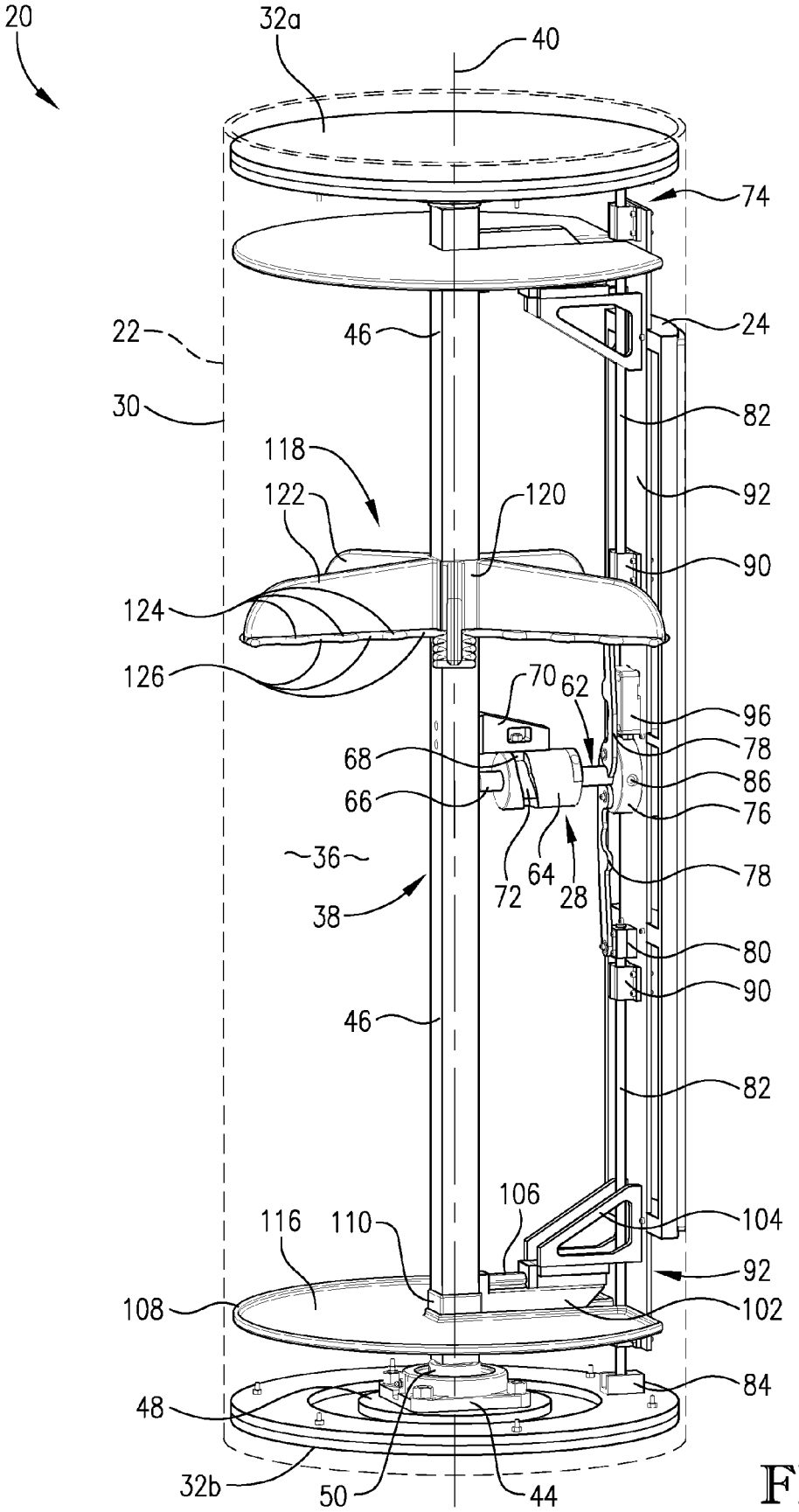
FIG. 2 is a partial isometric view, particularly illustrating the internal components of the safe.
Figure 5:
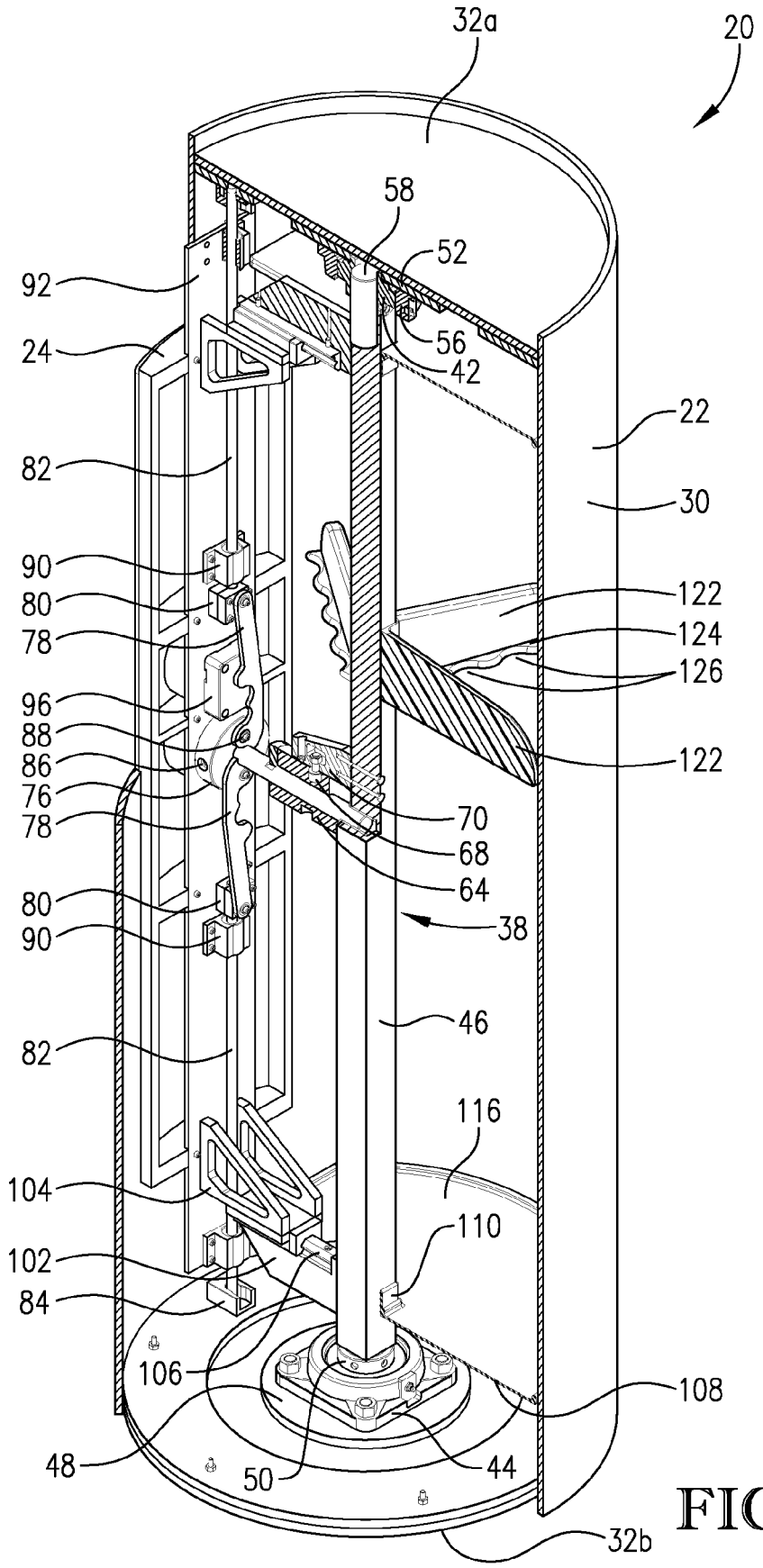
FIG. 5 is a partial isometric view of a gun safe constructed in accordance with the principles of the present invention, particularly illustrating the lock assembly, the door retraction assembly, and the support assembly.

Referring to FIG. 2, housing 22 of gun safe 20 defines an interior space 36. A support assembly 38 is disposed in interior space 36 and is rotatably coupled to housing 22. Support assembly 38 generally extends between end walls 32 of housing 22 along a longitudinal support axis 40. Preferably, opposite ends of support assembly 38 are pivotally coupled to respective upper and lower end walls 32*a*, 32*b* via an upper pivot joint 42 (shown in FIG. 5) and a lower pivot joint 44 so that support assembly 38 can be rotated relative to housing 22 on longitudinal support axis 40.

Referring particularly to FIGS. 2, 5, 8, and 15, support assembly 38 generally comprises a post 46 that is preferably rotatably coupled to upper end wall 32*a* via upper pivot joint 42, and rotatably coupled to lower end wall 32*b* via lower pivot joint 44. Lower pivot joint 44 includes an annular socket 50 and is rigidly coupled to a plate 48 that is, in turn, rigidly coupled to lower end wall 32*b* and is adapted to receive a rod 54 coupled to and extending from the lower end of post 46. Upper pivot joint 42 includes an annular socket 56 and is rigidly coupled to a plate 52 that is, in turn, rigidly coupled to upper end wall 32*a* and is operable to receive a rod 58 coupled to and extending from the upper end of post 46. Thus, upper pivot joint 42 and lower pivot joint 44 allow support assembly 38 to rotate relative to housing 22 on longitudinal support axis 40 while inhibiting translation of support assembly 38 relative to housing 22.

Referring to FIGS. 2, 4, 7, 10, and 14, door retraction assembly 28 at least partially couples door 24 to post 46. Door retraction assembly 28 generally includes a torque element 60, a rotating member 62, a cam 64, bushing 66, a cam-follower 68, and a cam-follower support 70. The torque element 60 may be any device that facilitates a rotational movement. In one embodiment, the torque element 60 is a generally cylindrical disk with two circular recesses in its planar outer surface, is at least partially accessible from outside the safe when the door 24 is closed, and allows an operator of the apparatus to easily open and close the device. The rotating member 62 is a generally cylindrical rod rigidly coupled and axially aligned to the torque element 60 at a first end. The cam 64 is generally cylindrical with a recessed channel 72 in the annular face and an annular hole along its major axis and fixably secured to the rotating member 62 therein so the cam 64 and rotating member 62 are axially aligned. The bushing 66 is fixed within an annular recess in post 46 to support rotating member 62 and allow rotating member 62 to translate along its longitudinal axis.

Cam-follower support 70 is fixably connected to post 46 at a first end. Cam-follower 68 is rotatingly connected near the second end of cam-follower support 70 and positioned so cam-follower 68 is disposed at least partially within the recessed channel of the cam 64. Rotation of the torque element 60 causes a corresponding rotation of the rotating member 62, and the cam 64, while the cam-follower 68 maintains a fixed position relative to the cam-follower support 70 and is disposed within the recessed channel 72 of the cam 64. Thus, the cam-follower 68 causes translation of cam 64 on a longitudinal axis relative to the bushing 66 when the torque element 60 is rotated through particular angles, depending on the length and orientation of the recessed channel 72 relative to the cam 64. Thus, in some embodiments, a rotation of torque element 60 through an angle of less than 360 degrees may cause a complete translation of cam 64 on a longitudinal axis relative to the bushing 66. In other embodiments, rotation of torque element 60 through an angle of less than 720 degrees may cause a complete translation of cam 64 on a longitudinal axis relative to the bushing 66.

Figure 6:
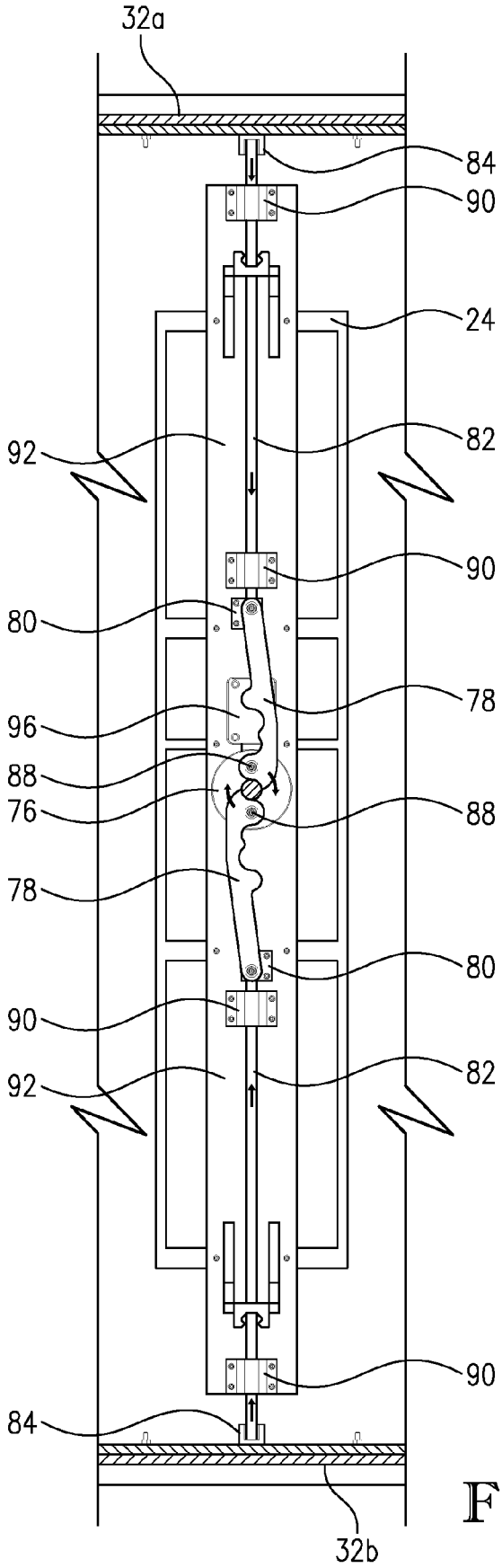
FIG. 6 is a sectional view particularly illustrating the lock assembly in a locked position and indicating movement required to unlock the mechanism.
Figure 7:
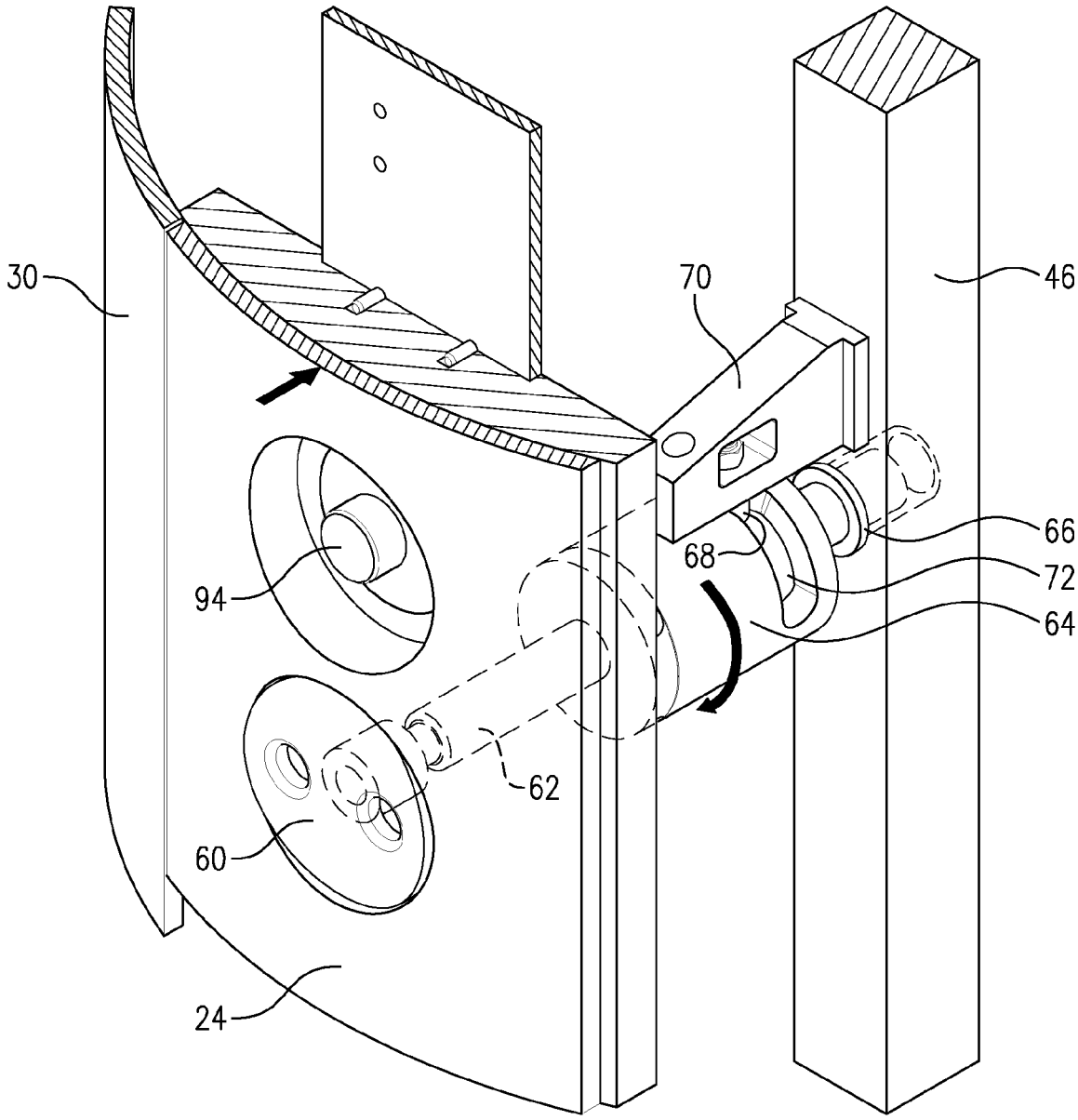
FIG. 7 is an partial isometric view similar to FIG. 4, particularly illustrating the components of the door retraction assembly and showing the door in the closed position and indicating movement required to unlock the mechanism.
Figure 8:
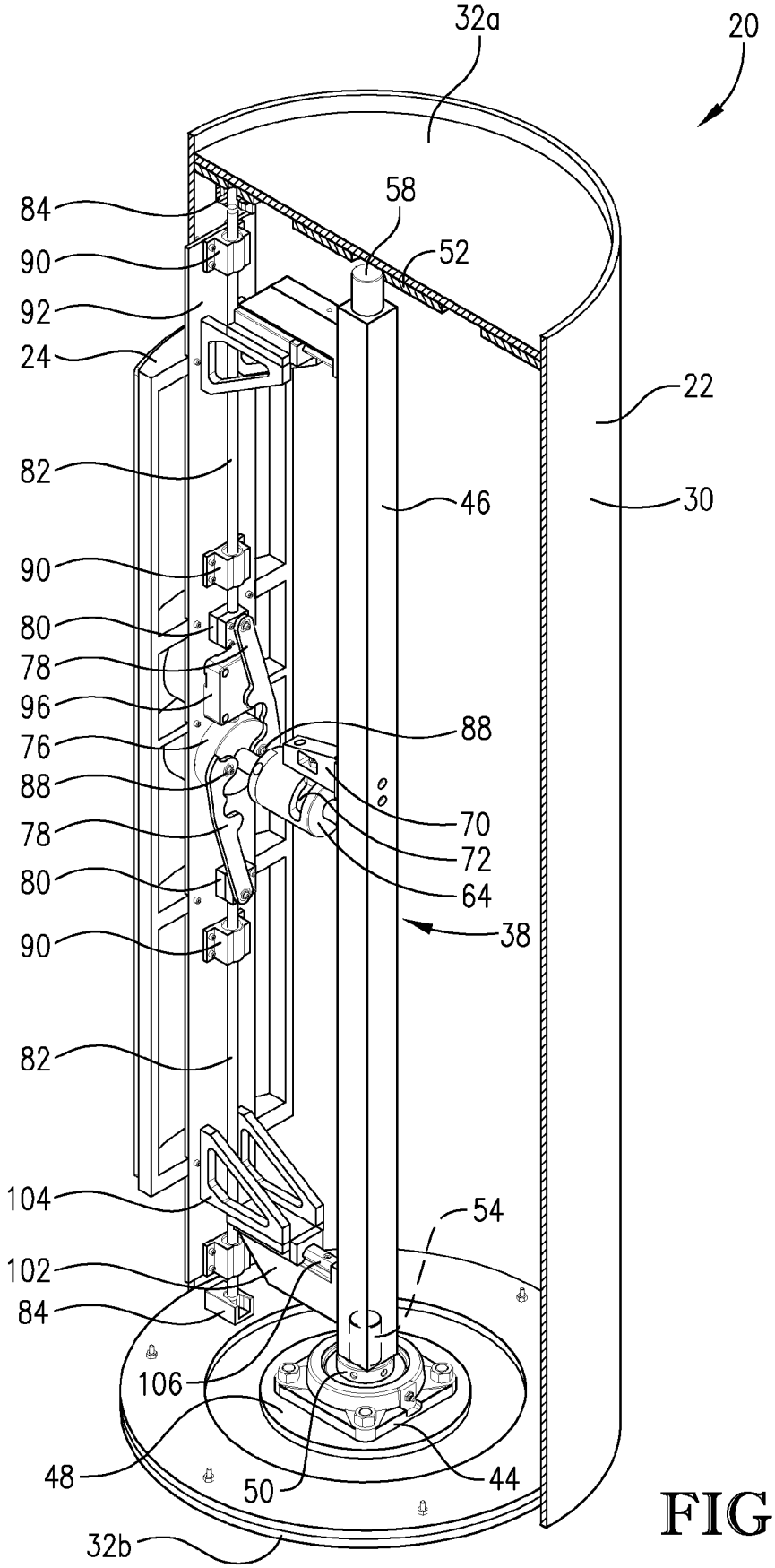
FIG. 8 is a partial isometric view similar to FIG. 5, but showing further detail of the support mechanism, upper and lower pivot joints and corresponding rods and showing the door in transition between the closed position to the open position and indicating the movement required to unlock the mechanism.
Figure 9:
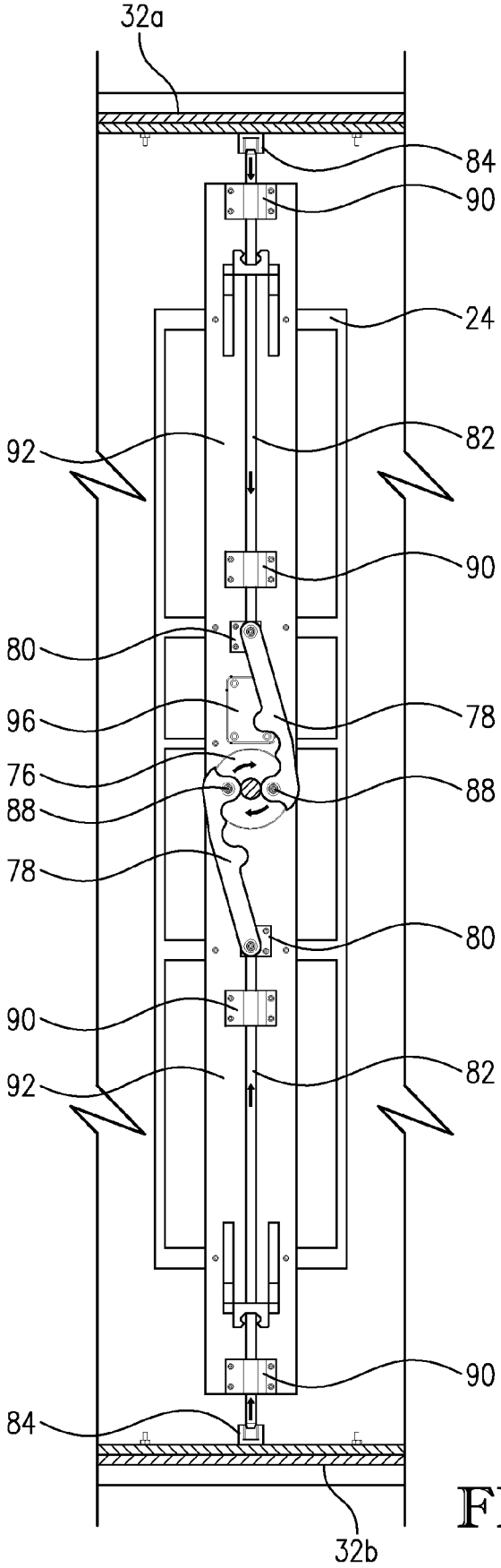
FIG. 9 is a sectional view similar to FIG. 6, but illustrating the lock assembly in transition between a locked and unlocked position and indicating movement required to unlock the mechanism.
Figure 10:
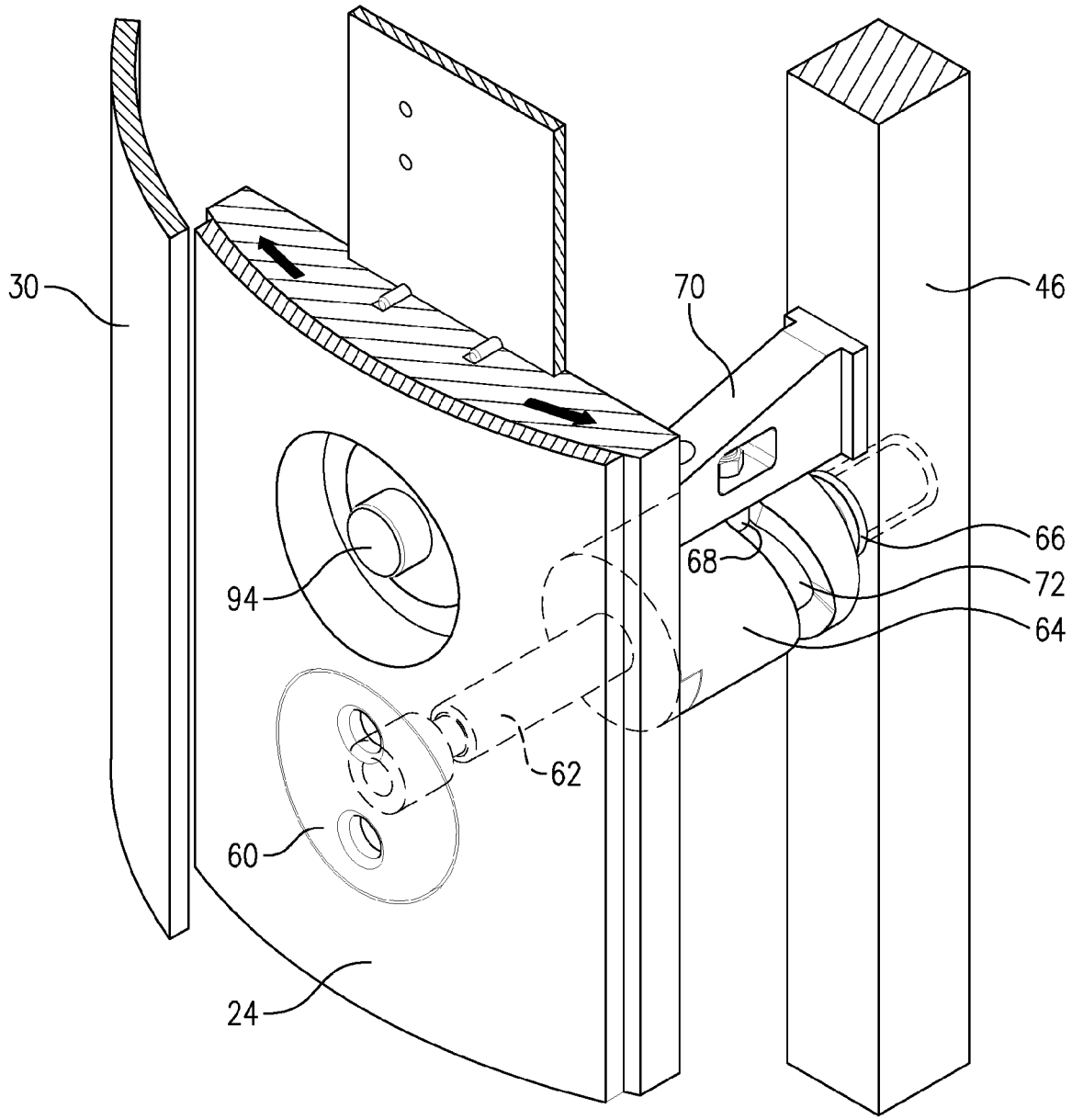
FIG. 10 is a partial isometric view similar to FIGS. 4 and 7, but illustrating the components of the door retraction assembly and showing the door in transition from the closed position to the open position and indicating movement required to unlock the mechanism.
Figure 11:
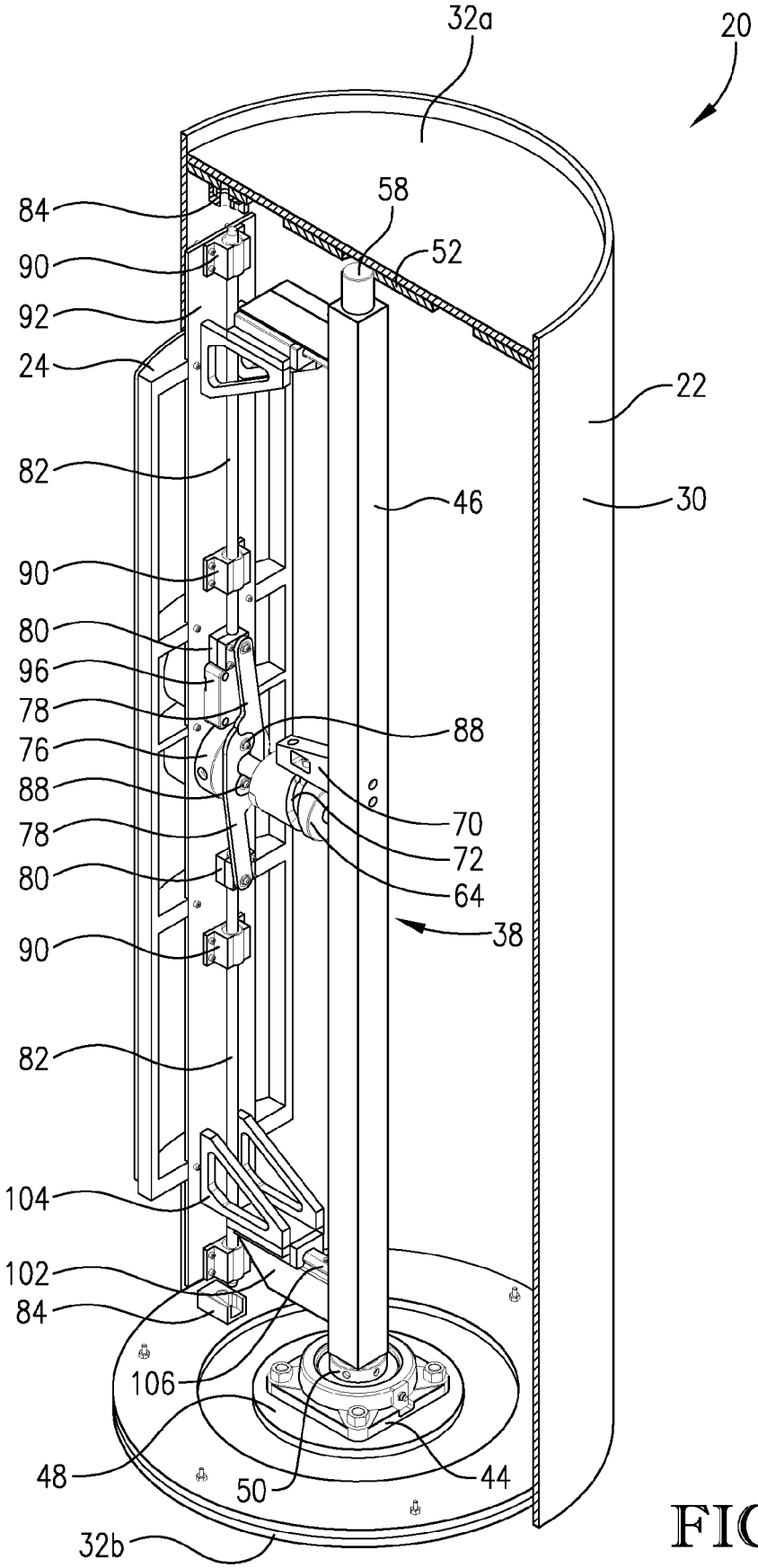
FIG. 11 is a partial isometric view similar to FIGS. 5 and 8, but showing further detail of the support mechanism, upper and lower pivot joints and corresponding rods and showing the door in the open position.
Figure 12:
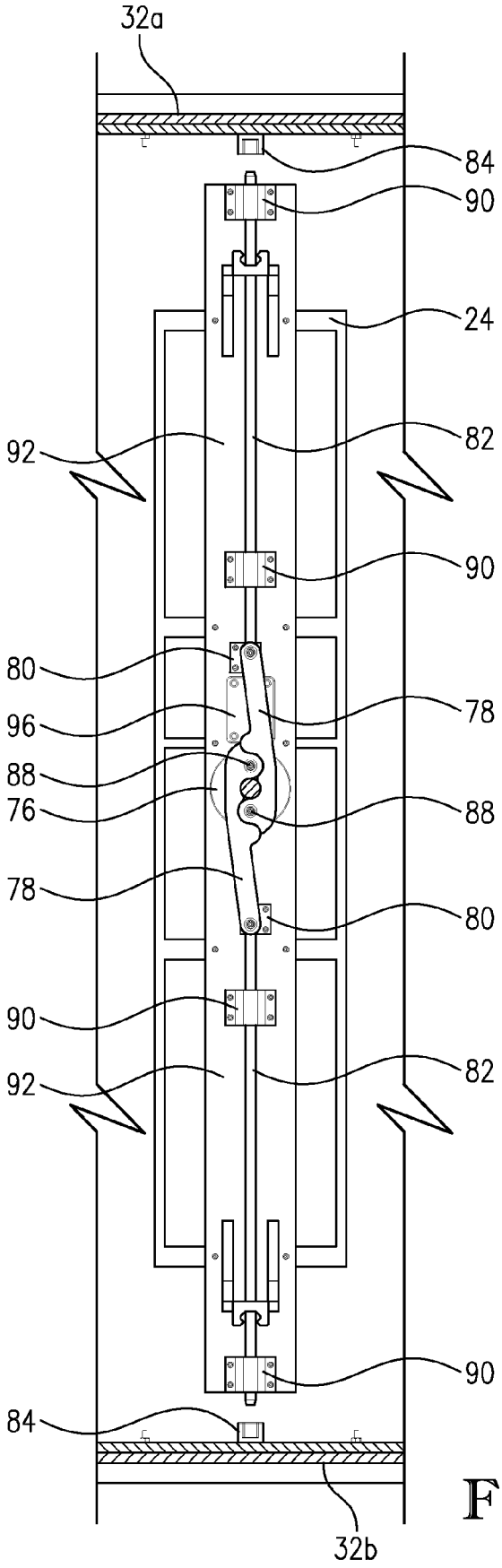
FIG. 12 is a sectional view similar to FIG. 6, but illustrating the lock assembly in the unlocked position.
Figure 13:
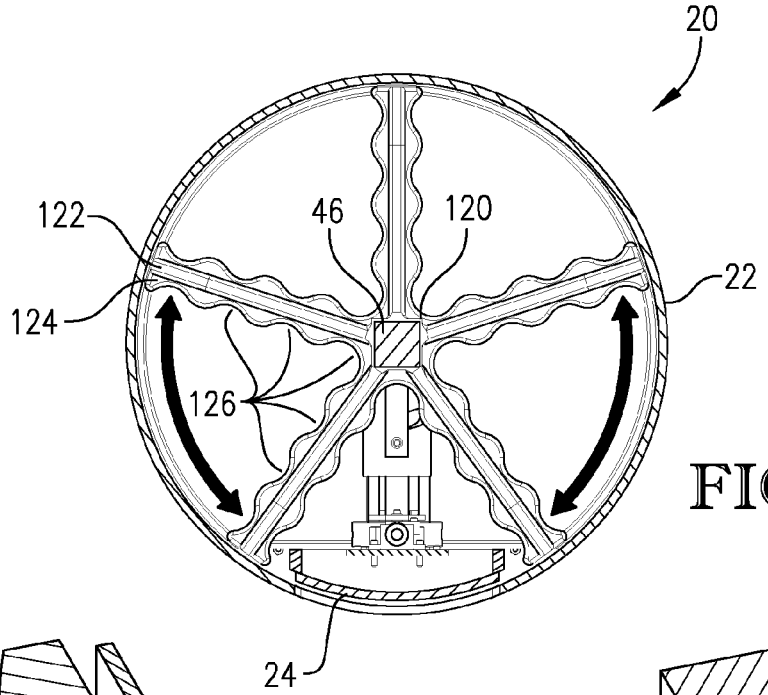
FIG. 13 is sectional top view, particularly illustrating the movement of the gun rest assembly.
Figure 14:
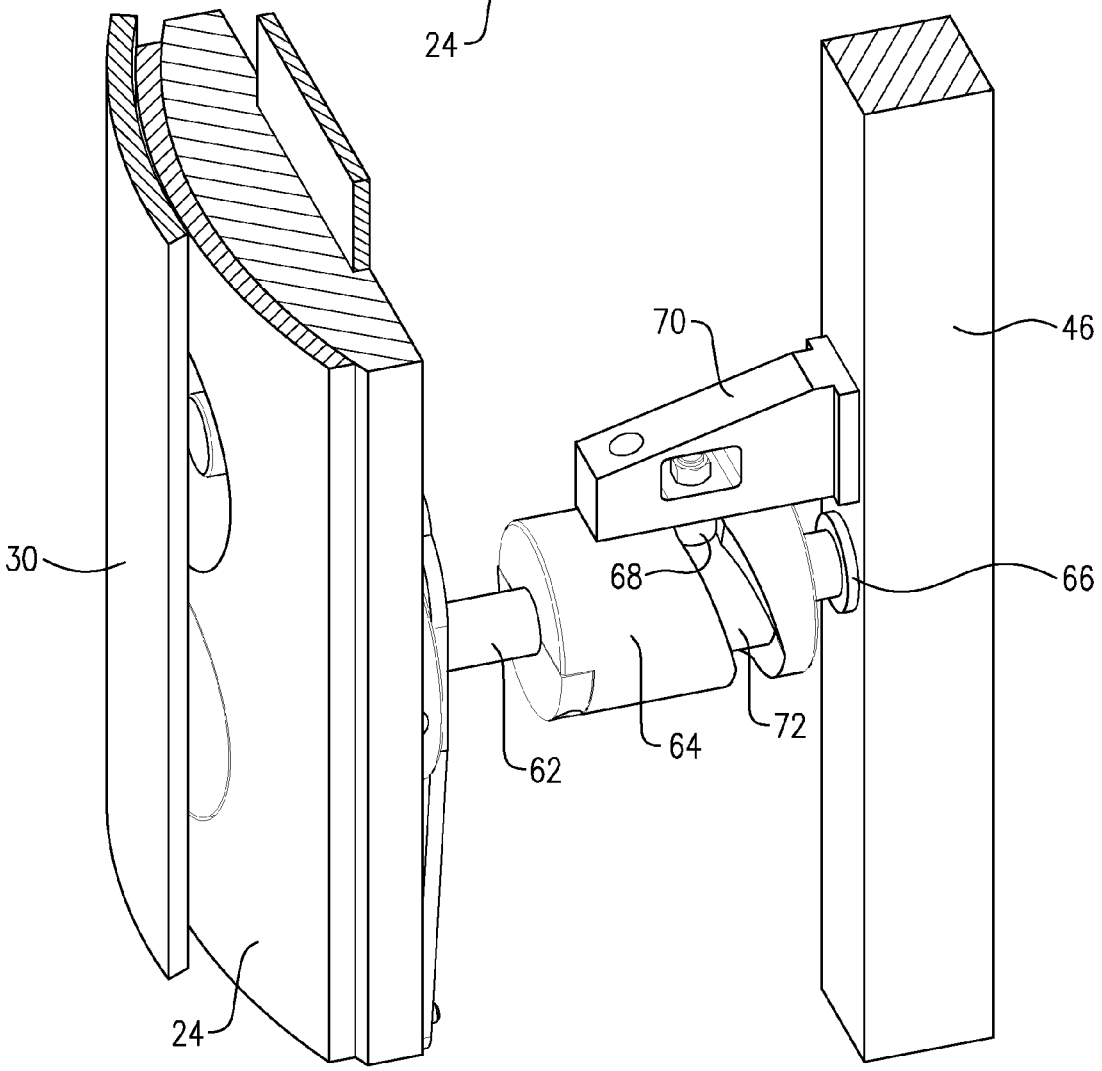
FIG. 14 is a partial isometric view similar to FIGS. 4, 7, and 10, but illustrating the components of the door retraction assembly and showing the door in the open position.
Figure 15:
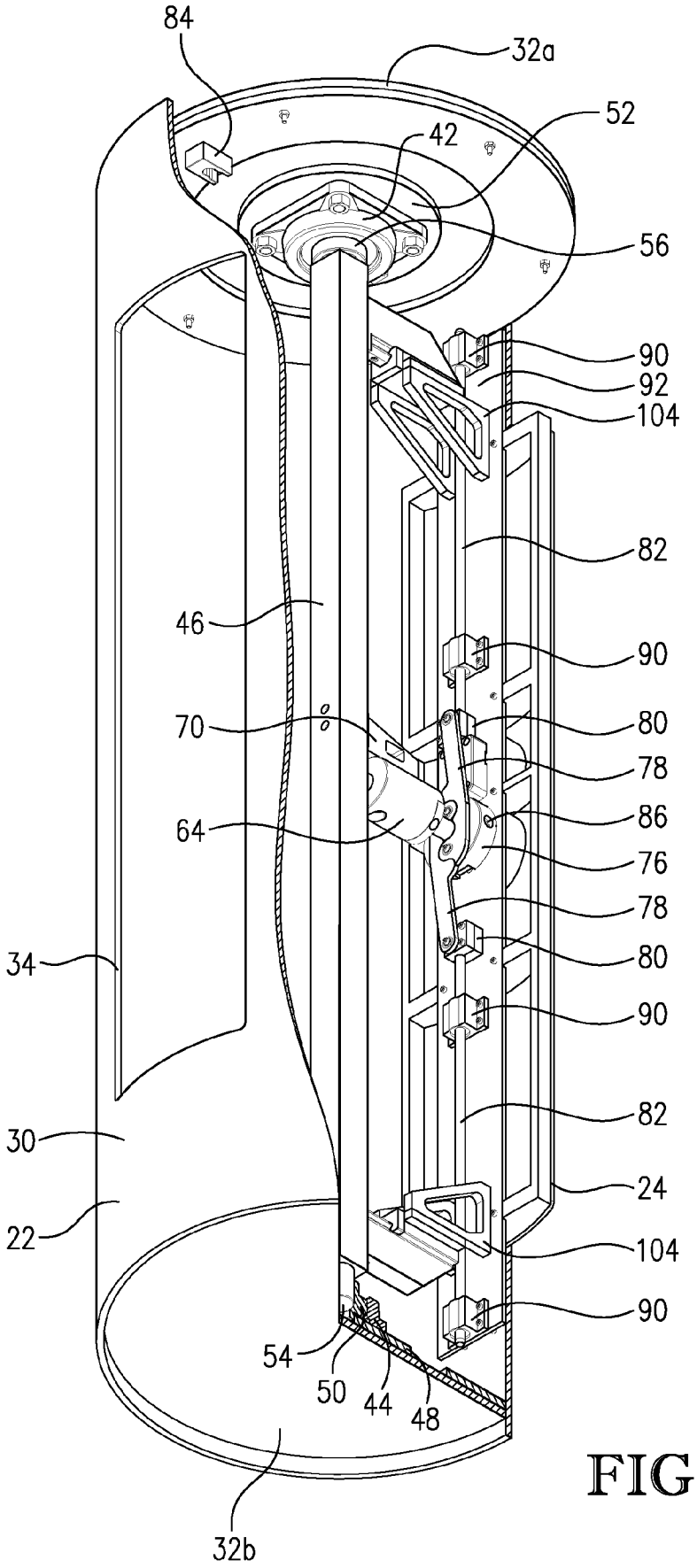
FIG. 15 is a partial isometric view, particularly illustrating the upper portions of the support mechanism and the upper pivot joint.

Turning to FIGS. 2-15, FIGS. 4-6 show an embodiment of the present invention in a closed and locked position, FIGS. 7-9 show an embodiment of the present invention in transition between closed and locked to open and unlocked, and FIGS. 10-12 show an embodiment of the present invention open and unlocked. As best shown in FIGS. 6, 9, and 12, locking system 74 generally comprises a bolt receiver 76, transfer arms 78, locking bar blocks 80, locking bars 82, and locking bar receivers 84. Bolt receiver 76 is a generally cylindrical disc with an axially aligned opening for receiving rotating member 62 therein and a set screw 86 (shown in FIG. 15) for securing rotating member 62 within bolt receiver 76. The transfer arms 78 are generally flat bars that are rotatably connected at their proximal end to bolt receiver 76 by eccentric pivots 88. The transfer arms 78 are pivotally connected at their distal end to corresponding locking bar blocks 80 with a bolt, pin, or other conventional fastener. The transfer arms 78 may be shaped with various curves to provide additional clearance around various portions of the apparatus, such as rotating member 62 or other transfer arms 78. The locking bar blocks 80 are generally square blocks for providing a secure attachment point between the transfer aims 78 and the locking bars 82. The locking bar blocks 80 may be a single piece or they may be two halves that are secured together to form a unitary whole. The locking bars 82 are generally cylindrical rods for engaging the locking bar receivers 84 at their distal end and thereby preventing movement of the door 24. The locking bars 82 fixedly connect to the locking bar blocks 80 at the proximal end. The locking bar supports 90 position and support the locking bars 82 and have a generally rectangular body with opposed flanges and an annular hole through the body. The locking bar 82 is placed within the annular hole and the locking bar supports 90 and are fixably attached to the door support assembly 92 by screws, bolts, welds, or other conventional fastening techniques, but may also be attached to the door 28 or other suitable location. The locking bar receivers 84 are generally block-shaped devices with a hole or channel cut therein for partially receiving the locking bars 82. The locking bar receivers 84 are preferably fixably connected to the upper and lower end walls 32*a*, 32*b*, but various other locations are possible. Thus, the door retraction assembly 28 is operable to shift door 24 between a closed position (shown in FIGS. 4 and 7) where the locking bars 82 engage the locking bar receivers 84 and a retracted position wherein the locking bars 82 disengage the locking bar receivers 84 and door 24 has been removed from opening 34 via the translational motion of door 24 towards or away from support assembly 38 (shown in FIGS. 10 and 14). In some embodiments, disengaging the locking bars 82 and opening the door 34, or closing the door 34 and engaging the locking bars 82, requires turning the torque element 60 through less an angle of less than 360 degrees. In other embodiments, turning the torque element 60 through less than 720 degrees may disengage the locking bars 82 and open the door 34, or close the door 34 and engage the locking bars 82.

Figure 3:
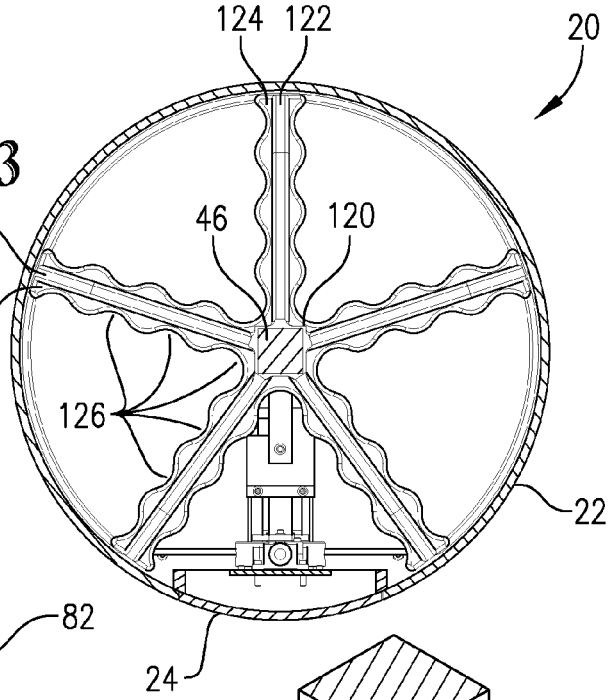
FIG. 3 is a sectional top view, particularly illustrating the gun rest assembly, the door retraction assembly, and the door brace assembly of the safe.
Figure 4:
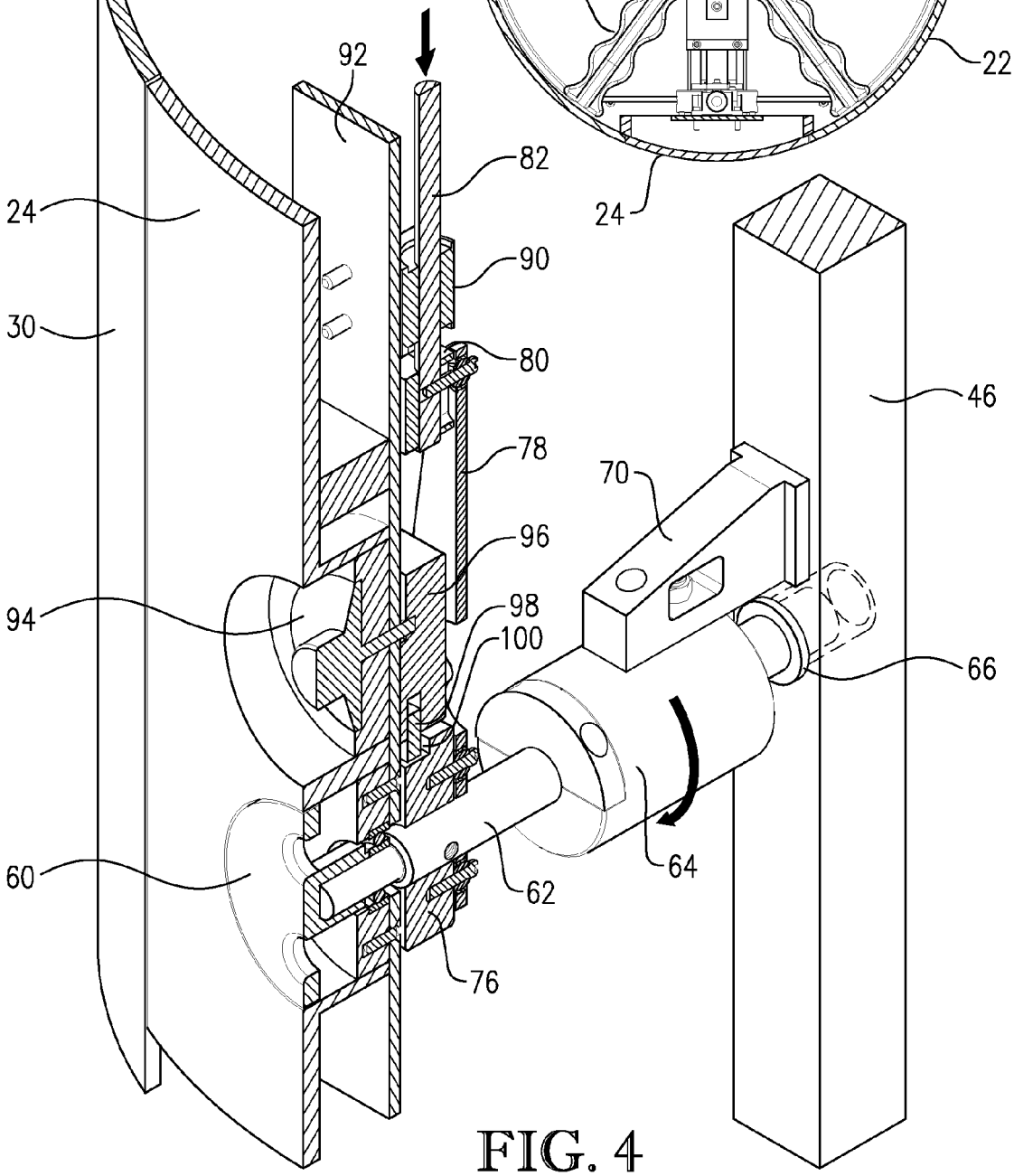
FIG. 4 is a partial isometric side view of the lock assembly and the door retraction assembly, particularly illustrating the interior components of the lock assembly and the door retraction assembly.

Referring to FIGS. 2-15, and particularly FIG. 4, lock assembly 26 is coupled to door 24 proximate door retraction assembly 28. Lock assembly 26 generally includes a dial 94 which is accessible from the outside of gun safe 20 and a lock housing 96 which is rigidly coupled to door 24. A lock bolt 98 is shiftably coupled to lock housing 96 and can be selectively inserted into and retracted from a recess 100 in bolt receiver 76. The shifting of lock bolt 98 can be controlled by rotating dial 94 in a pre-set manner (e.g., as in a conventional combination lock). When lock bolt 98 is received in recess 100, the rotation of bolt receiver 76 is inhibited, thereby preventing radial or translational movement of door 24 relative to support assembly 38. When lock bolt 98 is removed from recess 100, door 24 can be shifted relative to support assembly 38 by rotating torque element 60, rotating member 62, and cam 64. Although lock assembly 26 is illustrated herein as employing a standard combination lock, it is entirely within the ambit of the present invention for other locks, such as an electrical lock using a touch key pad, to be used.

Referring to FIGS. 2, 5, 8, 11, and 15, door support assembly 92 is employed to at least partially couple door 24 to support assembly 38. Door support assembly 92 preferably includes a second attachment element 102 rigidly coupled to lower portion of support assembly 38 and a first attachment element 104 rigidly coupled to door 24. Second attachment element 102 and first attachment element 104 are preferably slidably intercoupled so that when door 24 is shifted relative to support assembly 38, second attachment element 102 slides relative to first attachment element 104. The sliding connection between second attachment element 102 and first attachment element 104 is preferably provided by rail 106, which is rigidly coupled to second attachment element 102, which is rigidly coupled to post 46. Thus, door support assembly 92 can support door 24 on support assembly 38 while allowing for translation of door 24 relative to support assembly 38 between the closed position and the retracted position.

Referring to FIGS. 2, 3, 5, and 13, interior space 36 of gun safe 20 is preferably configured to hold a plurality of guns in a configuration wherein the guns can be easily accessed through opening 34 when door 24 is in the open position. The lower support member 108 is rigidly coupled to the lower portion of post 46 via a floor support collar 110. Lower support member 108 presents an upper surface 116 which extends generally perpendicular to longitudinal support axis 40.

Referring to FIGS. 2 and 9, a gun rest assembly 118 is preferably coupled to an upper portion of post 46 via a gun support collar 120. Gun rest assembly 118 generally includes a plurality of support arms 122 rigidly coupled to gun support collar 120 and extending radially outward from longitudinal support axis 40. A gun holder 124 is coupled to each support arm, and is operable to support a gun in a generally upright position. Preferably, the butt end of the guns stored in gun safe 20 rest on upper surface 116 of lower support member 108 while the barrel portion of the guns rests against gun holders 124 so that the guns are supported in a generally upright position within gun safe 20. Because gun rest assembly 118 and lower support member 108 are rigidly coupled to post 46, when post 46 is rotated relative to housing 22, gun rest assembly 118, and lower support member 108 rotate (like a carrousel) post 46 on longitudinal support axis 40.

Referring to FIG. 3, gun rest assembly 118 preferably includes a plurality of recesses 126 in gun holders 124 for receiving and holding the barrels of a plurality of guns. The configuration of gun rest assembly 118 allows a large number of guns to be stored and supported within gun safe 20. Further, because gun rest assembly 118 can be rotated on post 46 when door 24 is in the open position, access to any gun supported by any gun holder 124 can be easily had by simply rotating support assembly 38 like a carrousel.

In use, a user rotates rotates dial 94 in a pre-set manner and rotates torque element 60 in a first direction to cause the locking bars 82 to retract and disengage the locking bar receivers 84. Further rotation of the torque element 60 causes the door 24 to translate radially inward. The user then rotates the door around longitudinal support axis 40 to provide unobstructed access to all areas of the interior space 36. The user can remove firearms from or place firearms within the gun safe 20 with the firearms supported in an upright position against gun holders 124. When finished, the user rotates the door 24 so it aligns with the opening 34 and rotates the torque element 60 in a second direction causing the door 24 to translate radially outward so the outer face of the door 24 is generally aligned with the sidewall 30 of the housing 22 and causing the locking bars 82 to extend and engage the locking bar receivers 84.

Figure 16:
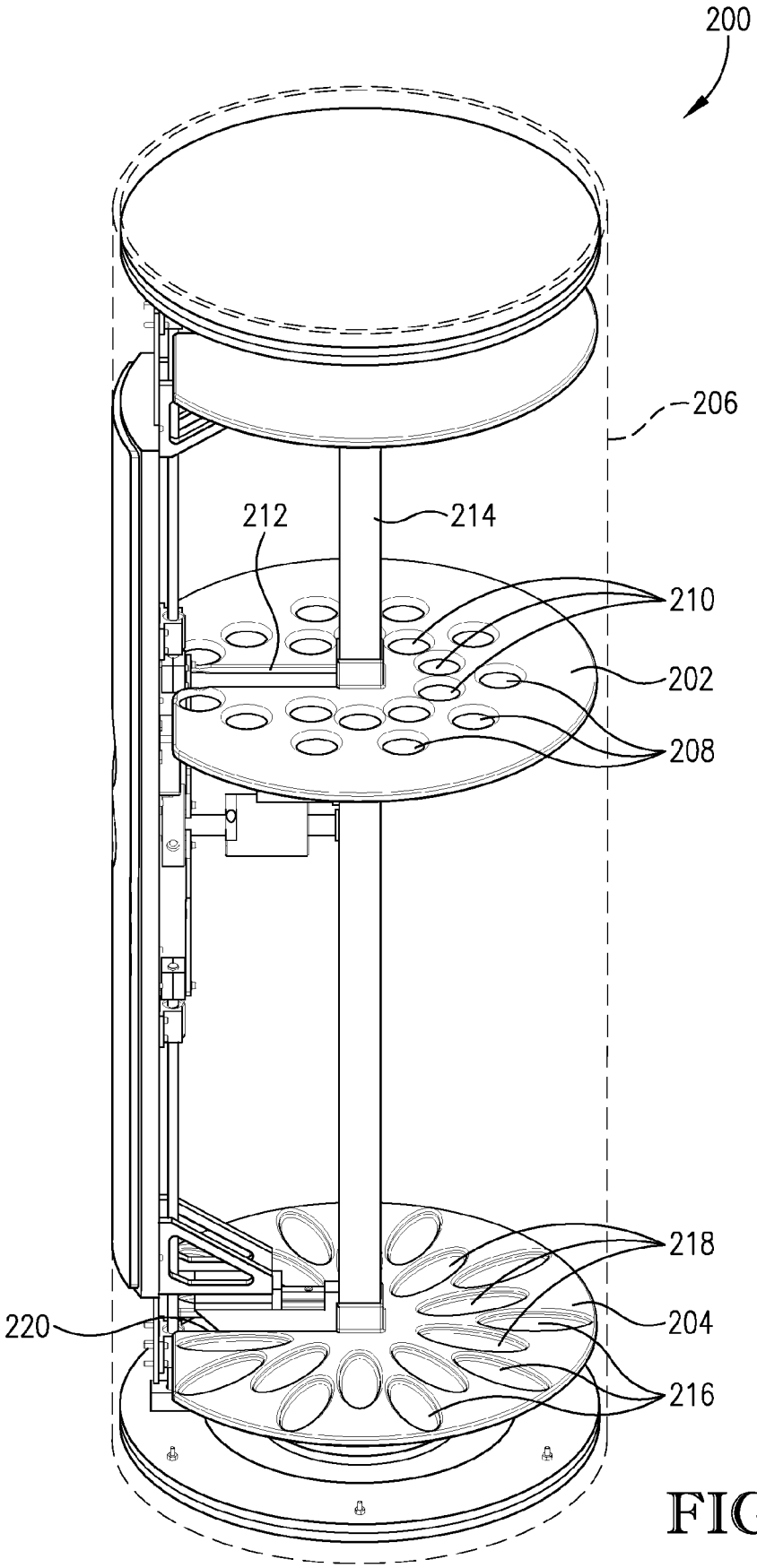
FIG. 16 is a partial isometric view of an alternative embodiment of a gun safe constructed in accordance with the principles of the present invention, particularly illustrating the gun holder and floor plate.

Referring to FIG. 16, a gun safe 200 including alternate embodiments of gun holder 202 and lower support member 204 is illustrated. This embodiment is substantially similar to the embodiment of FIGS. 1-15, except as described.

In this embodiment, gun holder 202 generally comprises a flat disc with a diameter less than the interior diameter of housing 206 and height substantially shorter than its diameter. Gun holder 202 comprises a plurality of outer gun-barrel-receiving openings 208, a plurality of inner gun-barrel-receiving openings 210, and a positioning slot 212 having a width substantially the same as one face of post 214. Gun holder 202 preferably comprises a material that will not mar the finish of a gun barrel, but may be constructed of any rigid material. Gun holder 202 may alternately be constructed of a first material and partially or completely coated with a second material to reduce marring. The inner gun-barrel-receiving openings 210 are preferably round or oval openings disposed generally along a first radius from the center of the gun holder 202 for supporting the barrels of firearms placed within the gun safe 200. The outer gun-barrel-receiving openings 208 are preferably round or oval openings disposed generally along a second radius from the center of gun holder 202 for supporting the barrels of firearms placed within gun safe 200.

Lower support member 204 is a flat disc with a diameter substantially the same as gun holder 202 and a height substantially shorter than its diameter. Lower support member 204 comprises a plurality of outer gun-butt-receiving recesses 216 and a plurality of inner gun-butt-receiving recesses 218, and a positioning slot 220 having a width substantially the same as one face of post 214. Lower support member 204 preferably comprises a material that will not mar the finish of a gun stock, but may be constructed of any rigid material. Lower support member 204 may alternately be constructed of a first material and partially or completely coated with a second material to reduce marring. The inner gun-butt-receiving recesses 218 are generally oval, and sufficiently large to accommodate a variety of firearms, sufficiently deep to securely hold the butt of a firearm, and generally aligned below a corresponding inner gun-barrel-receiving opening 210 generally along a first radius from the center of the lower support member 204. The outer gun-butt-receiving recesses 216 are generally oval, and sufficiently large to accommodate a variety of firearms, sufficiently deep to securely hold the butt of a firearm, and generally aligned below a corresponding outer gun-barrel-receiving opening 208 generally along a second radius from the center of the lower support member 204. The major axis of the inner and outer gun-butt-receiving recesses 218, 216 are preferably oriented along a radial axis of the lower support member 204 to accommodate a maximal number of firearms, as shown in FIG. 16.

Figure 17:
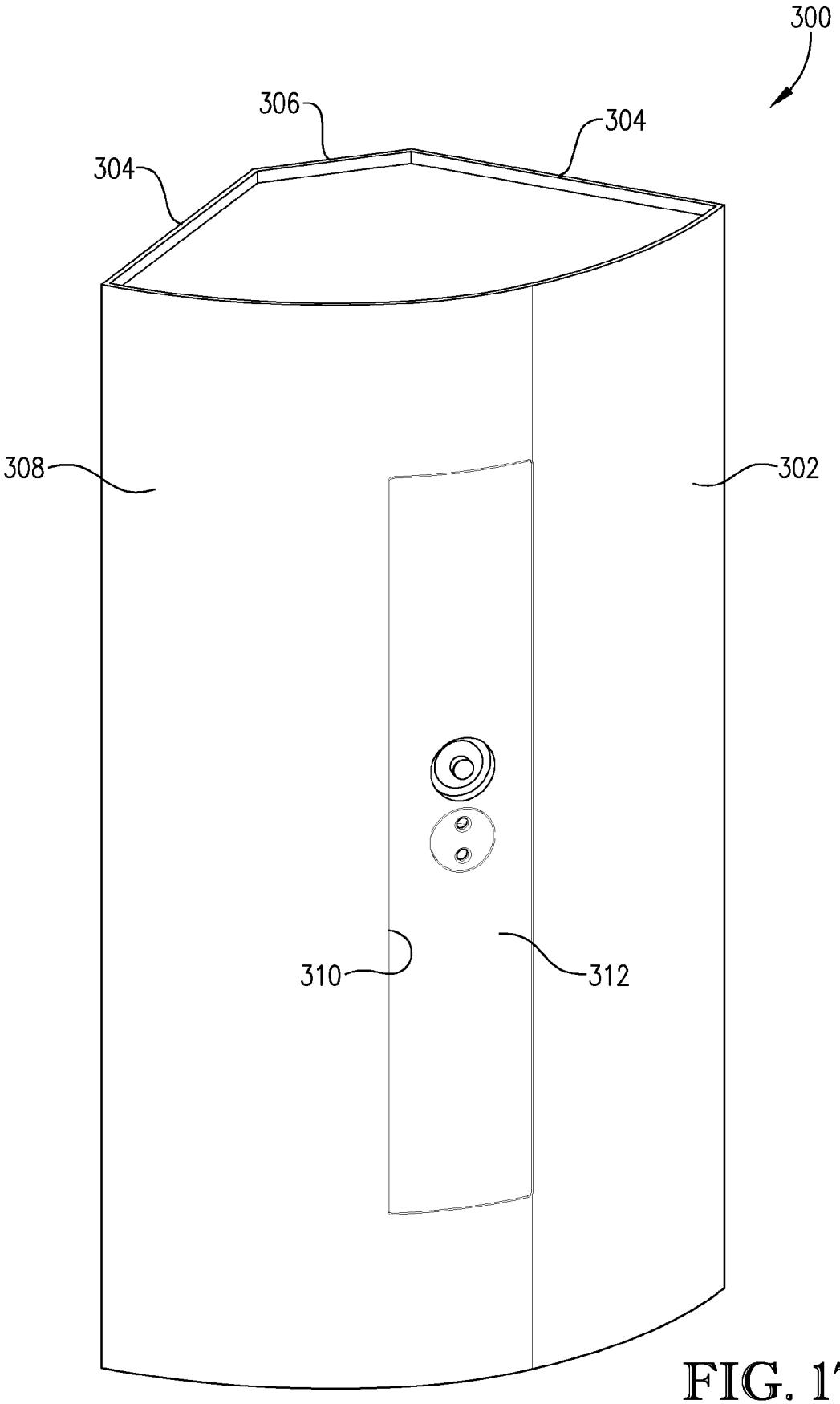
FIG. 17 is an isometric view of another alternative embodiment of a gun safe constructed in accordance with the principles of the present invention, particularly illustrating a chamfered-pie-wedge housing.
Figure 18:
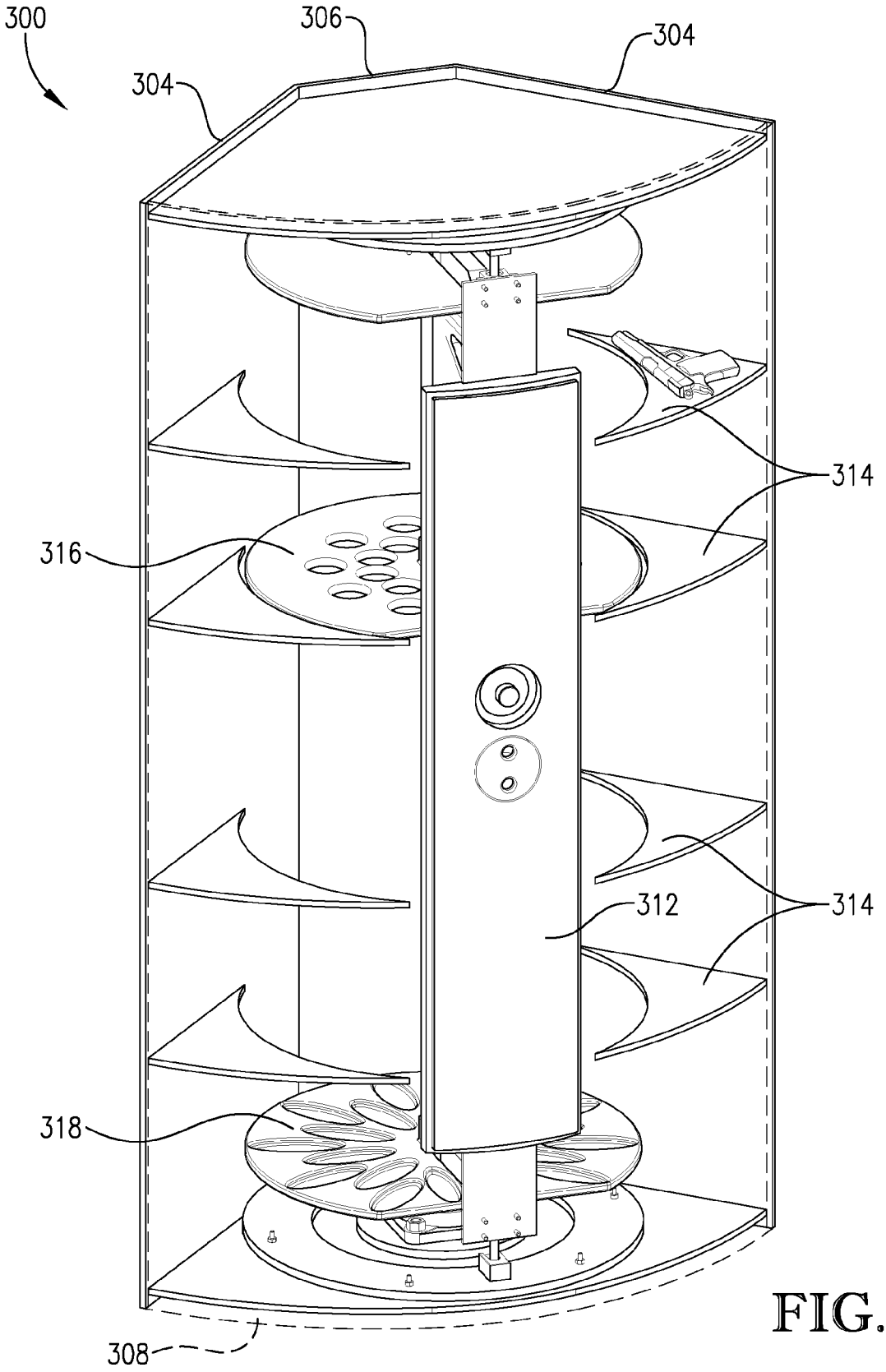
FIG. 18 is a partial isometric view, particularly illustrating the gun holder and floor plate.

Referring to FIGS. 17 and 18, a gun safe 300 comprising a chamfered-pie-wedge shaped housing 302 which is configured to fit in a corner. The gun safe 300 is substantially similar to that disclosed above with reference to FIGS. 1-16, except as described below. Housing 302 generally includes two substantially flat side walls 304, one substantially flat back wall 306, and one curved front wall 308. The two side walls are oriented generally perpendicular to each other. The back wall 306 is oriented at approximately forty-five degrees to each side wall 304 and defines a chamfer between the side walls 304, as seen from above. The front wall 308 defines an opening 310 therein within which a door 312 can be received.

Referring to FIG. 18, the interior of gun safe 300 further comprises a plurality of shelves 314 for supporting various items within the gun safe 300 and disposed in the corners with one edge of shelf 314 along a side wall 304, and another edge along the front wall 308. The remaining edge of the shelf is shaped complimentary to the gun holder 316 and lower support member 318 to avoid overlapping the firearm storage area. Thus, the shelves 314 have one flat side, one curved convex side, and one curved concave side. The shelves may be fixedly attached to side wall 304 and front wall 308, or the shelves may be adjustable using conventional means.

Figure 19:
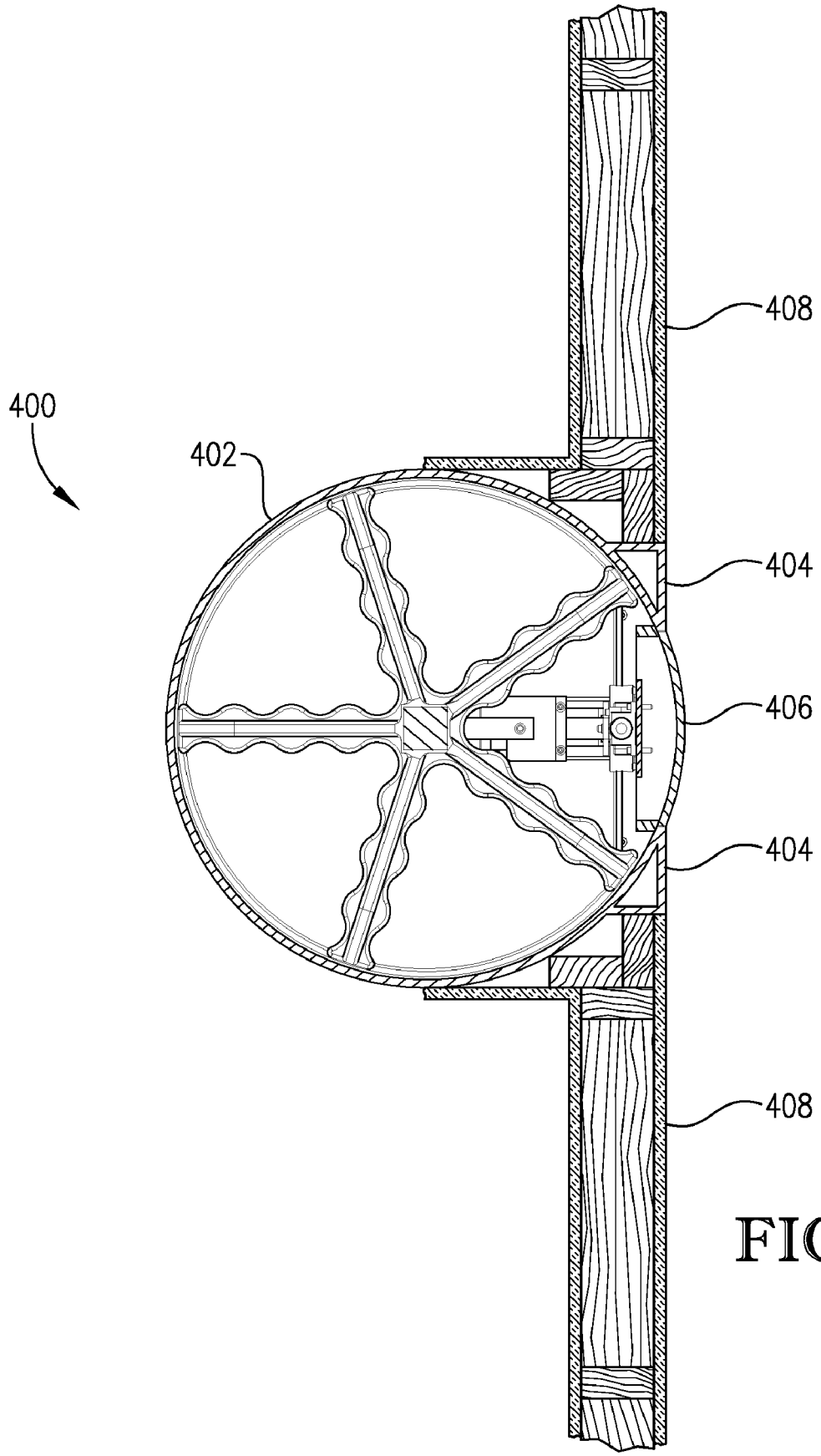
FIG. 19 is an section top view of yet another alternative embodiment of a gun safe constructed in accordance with the principles of the present invention, particularly illustrating the triangular flanges on the housing of the gun safe.

Referring to FIG. 19, a gun safe 400 is illustrated as comprising a housing 402 configured for permanent installation within a building or other structure. This embodiment is substantially similar to the embodiments described with reference to FIGS. 1-15, with the exception of the triangular flanges 404 immediately lateral to the door 406. The triangular flanges 404 provide a flat surface that aligns with the surface of a wall 408 and preferably extend the entire vertical length of housing 402.

Figure 20:
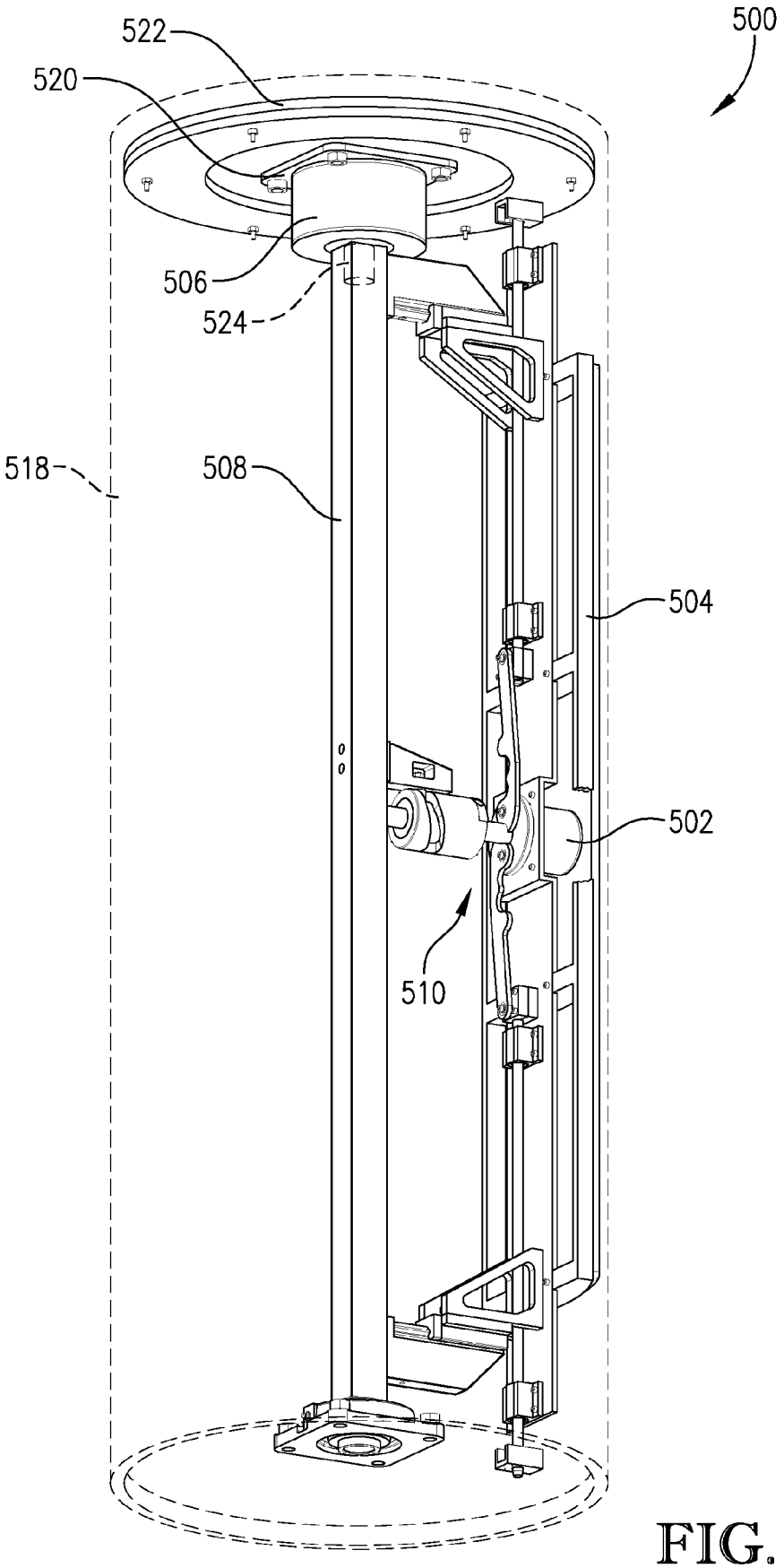
FIG. 20 is an partial isometric view of another alternative embodiment of a gun safe constructed in accordance with the principles of the present invention, particularly illustrating the first and second automatic mechanical actuators.
Figure 21:
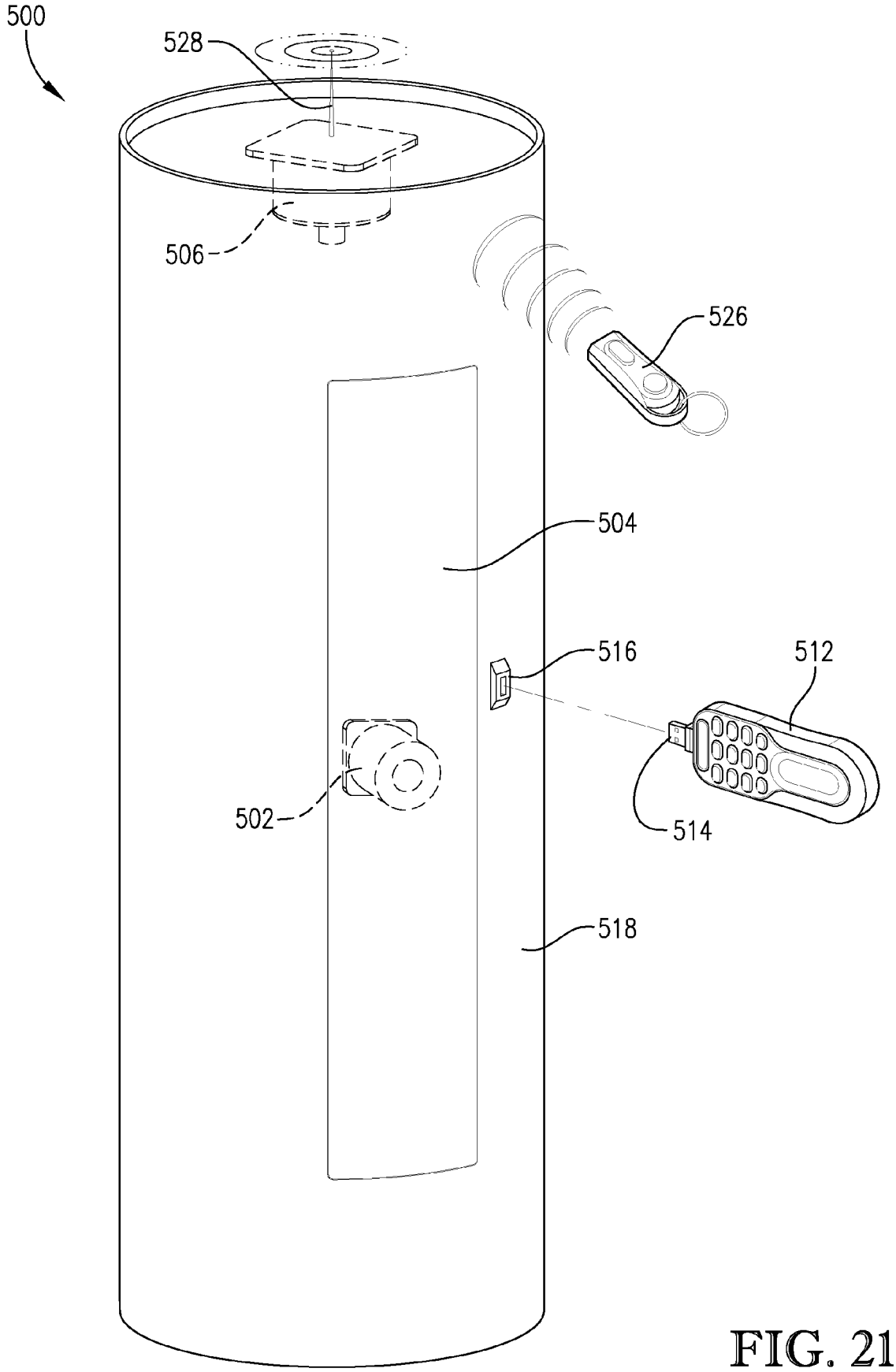
FIG. 21 is an isometric view, particularly illustrating the first and second automatic mechanical actuators, a USB security device, and a remote control.

Referring to FIGS. 20 and 21, a gun safe 500 is illustrated as additionally comprising a first automatic mechanical actuator 502 (e.g., an electric or hydraulic motor) for locking and unlocking the door 504 and a second automatic mechanical actuator 506 for rotating the post 508. This embodiment is substantially similar to the embodiments described with reference to FIGS. 1-15, except as described. First automatic mechanical actuator 502 replaces or works in conjunction with torque element 60 of FIGS. 1-15 for locking and extending or unlocking and retracting door 504. First automatic mechanical actuator 502 is preferably fixedly connected to door support assembly by a conventional means and where the armature (not shown) of the first automatic mechanical actuator 502 axially aligns with, and is fixably connected to, the rotatable member 510. Thus, rotation of the armature causes rotation of the rotatable member 510 to retract and unlock the door 504, as described in relation to FIGS. 1-15, above. First automatic mechanical actuator 502 may be signaled to open or close the door 504 by any device, or combination of devices, such as buttons, a keypad, keycard, remote control, or biometric security device. As shown in FIG. 21, actuator 502 may be signaled to open or close with a USB security device 512. The USB connector 514 of security device 512 is placed within a USB socket 516 on the housing 518 and a security code is entered. If a user enters the correct code, first automatic mechanical actuator 502 is signaled to open the door 504.

Second automatic mechanical actuator 506 (e.g., an electric or hydraulic motor) replaces upper pivot joint 42 or lower pivot joint 44, as described in relation to FIGS. 1-15, and causes rotation of post 508. Second automatic mechanical actuator 506 is rigidly coupled to plate 520 that is, in turn, rigidly coupled to upper end wall 522 and is adapted to receive rod 524 coupled to and extending from the upper end of support structure 508. Rod 524 preferably has a square cross-section, but may be any shape. Second automatic mechanical actuator 506 may be signaled to rotate by any device, such as, for example, buttons, a rotating dial, or a remote control. Preferably, a remote control 526 and an antenna 528 attached to the automatic mechanical actuator 506 are used so that a user may press a button to cause second automatic mechanical actuator 506 to rotate the gun holders and floor plate (not shown).

In various alternate embodiments, the first and second automatic mechanical actuators 502, 506 may be connected to the rotatable member 510 and rod 524, respectively, directly or gears, pulleys or belts, as necessary under the circumstances.

Figure 22:
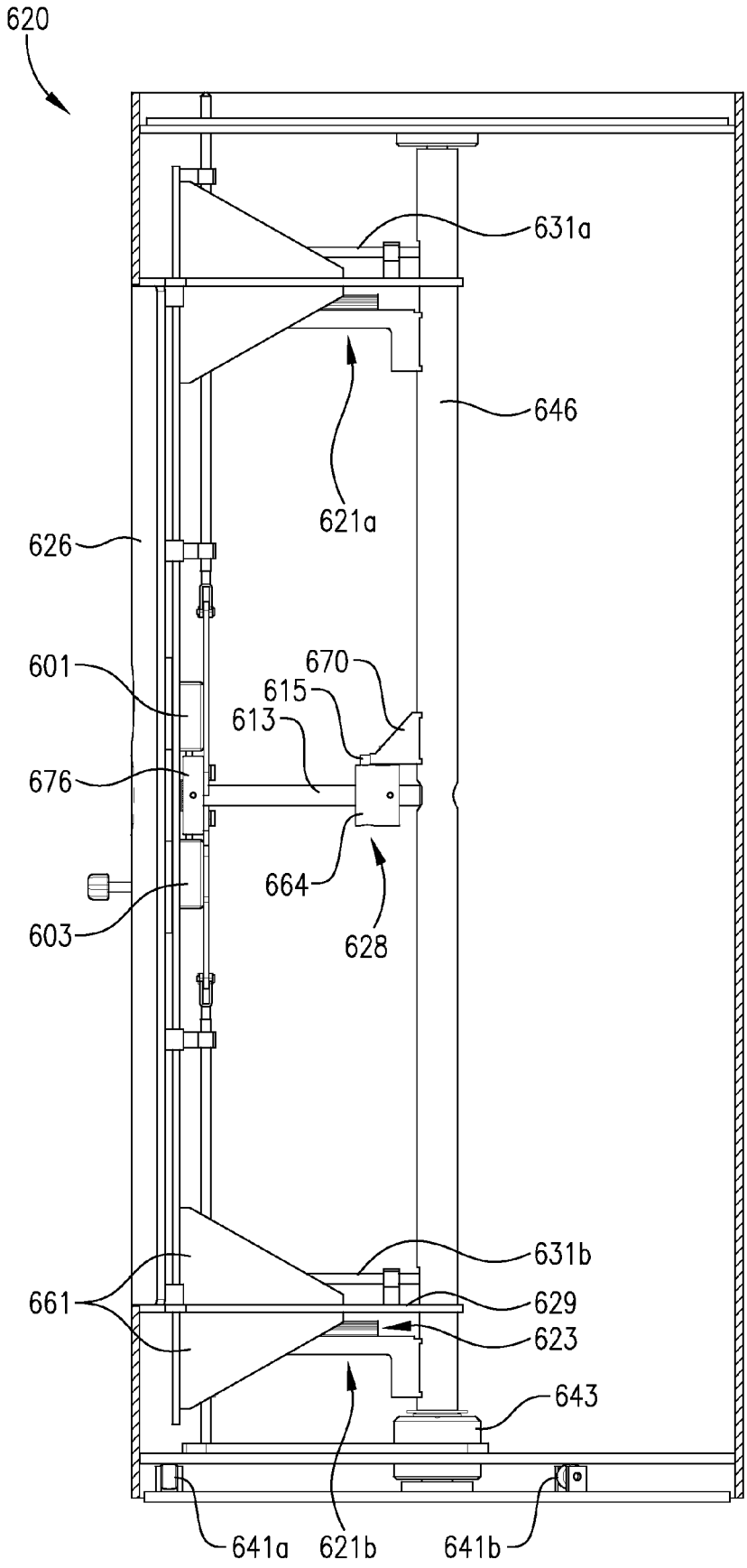
FIG. 22 is cut-away side view of a gun safe constructed in accordance with one embodiment of the present invention, where the door features two locks and the door locking, shifting, and supporting systems are equipped with additional mechanisms for preventing forced entry into the safe.
Figure 23:
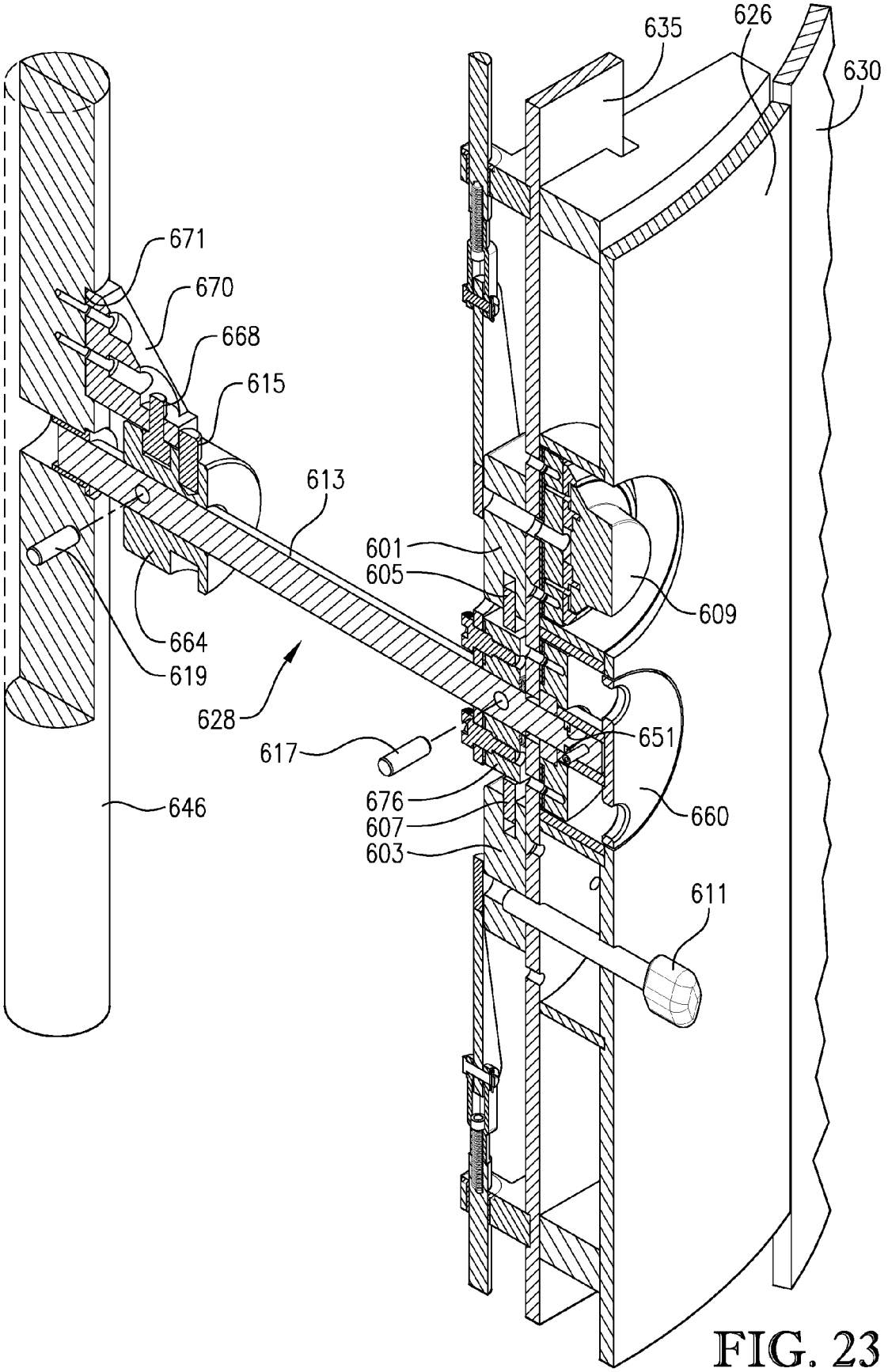
FIG. 23 is an enlarged partial isometric view of the door locking and shifting systems of the safe depicted in FIG. 22, particularly illustrating the dual lock configuration and a stop pin on the cam for additional protection against forced entry.
Figure 24:
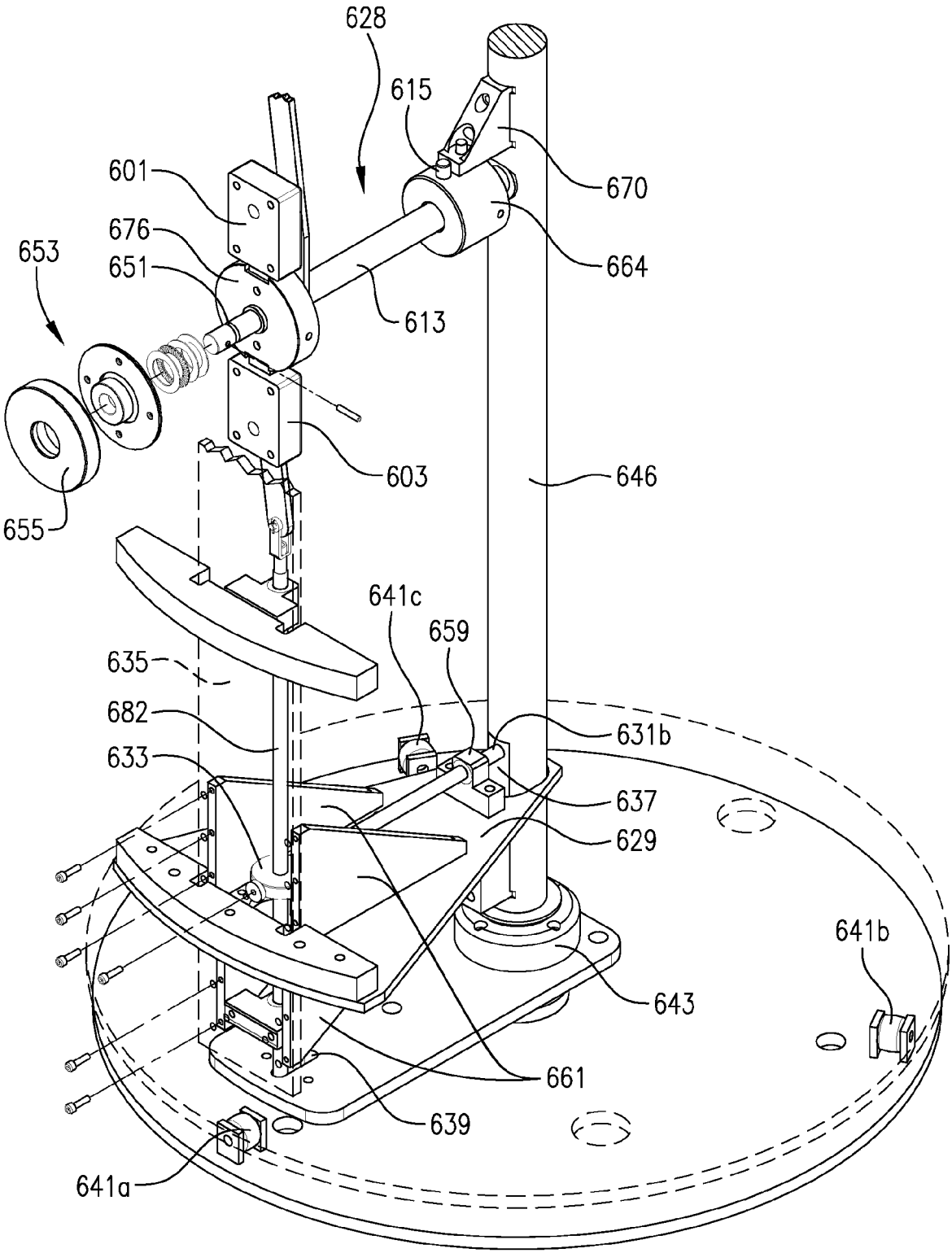
FIG. 24 is an enlarged partial isometric assembly view of the door locking, shifting, and supporting systems of the safe depicted in FIG. 22, particularly illustrating the dual lock configuration, an anti-drill assembly, and a radial lock bar extending between the door and the central support near the lower door support assembly.

FIGS. 22-26 depict a safe 620 that is equipped with several additional mechanisms that make the safe 620 more resistant to break-in. For example, FIGS. 22-24 show the safe 620 as including both an upper lock 601 and a lower lock 603. The upper and lower locks 601, 603 include respective shiftable lock elements 605, 607 (FIG. 23) that can each be shifted into and out of respective notches formed in the bolt receiver 676. The upper and lower locks 601, 603 can be of a type selected from the group consisting of combination locks, key-operated locks, electronic touch pad locks, mechanical touch pad locks, remote control locks, fingerprint locks, and retinal scan locks. In the embodiment depicted in FIGS. 22-24, the upper lock 601 is a combination lock having a dial 609 and the lower lock 603 is a key-operated lock having a key 611.

Another security feature depicted in FIGS. 22-24 is a stop pin 615 that is coupled to the cam 664 of the door retraction assembly 628. When the door 626 is in the closed and locked position, the stop pin 615 is aligned with an outer face of the cam-follower support 670 in a manner so that if a person attempted to break into the safe 620 by applying an impact force near the middle of the door 626 from the outside, the stop pin 615 would engage the outer face of the cam-follower support 670 to thereby prevent the door 626 from being forced inward towards the central support post 646. When the cam 664 is rotated out of the closed and locked position, the stop pin 615 is no longer aligned with the cam follower support 670 and allows the door 626 to be retracted inwardly toward the central support post 646.

FIGS. 23 and 24 show that the rotatable shaft 613 of the door retraction assembly 628 includes a circumferential shearing groove 651 near the terminal end of the shaft 613. This shearing groove 651 creates an intentional area of weakness in the rotatable shaft 613 so that if a person were to try to gain entry into the safe 620 by breaking the rotatable shaft 613, the rotatable shaft 613 would break proximate the shearing groove 651, leaving the rest of the shaft 613 securely in position to prevent entry into the safe 620. Additionally, as depicted in FIG. 24, an anti-drill assembly 653 can be coupled to the rotatable shaft 613 on the outside of the bolt receiver 676. The anti-drill assembly 653 includes a hardened rotatable disk 655 that helps prevent a person from drilling into the bolt receiver 676 from outside the safe 620. Also, as depicted in FIG. 23, hardened pins 617 and 619 can be used to attach bolt receiver 676 and cam 664, respectively, to the rotatable shaft 613. These pins 617, 619 are both difficult to shear and difficult to drill through, thus making the safe 620 more secure.

Figure 25:
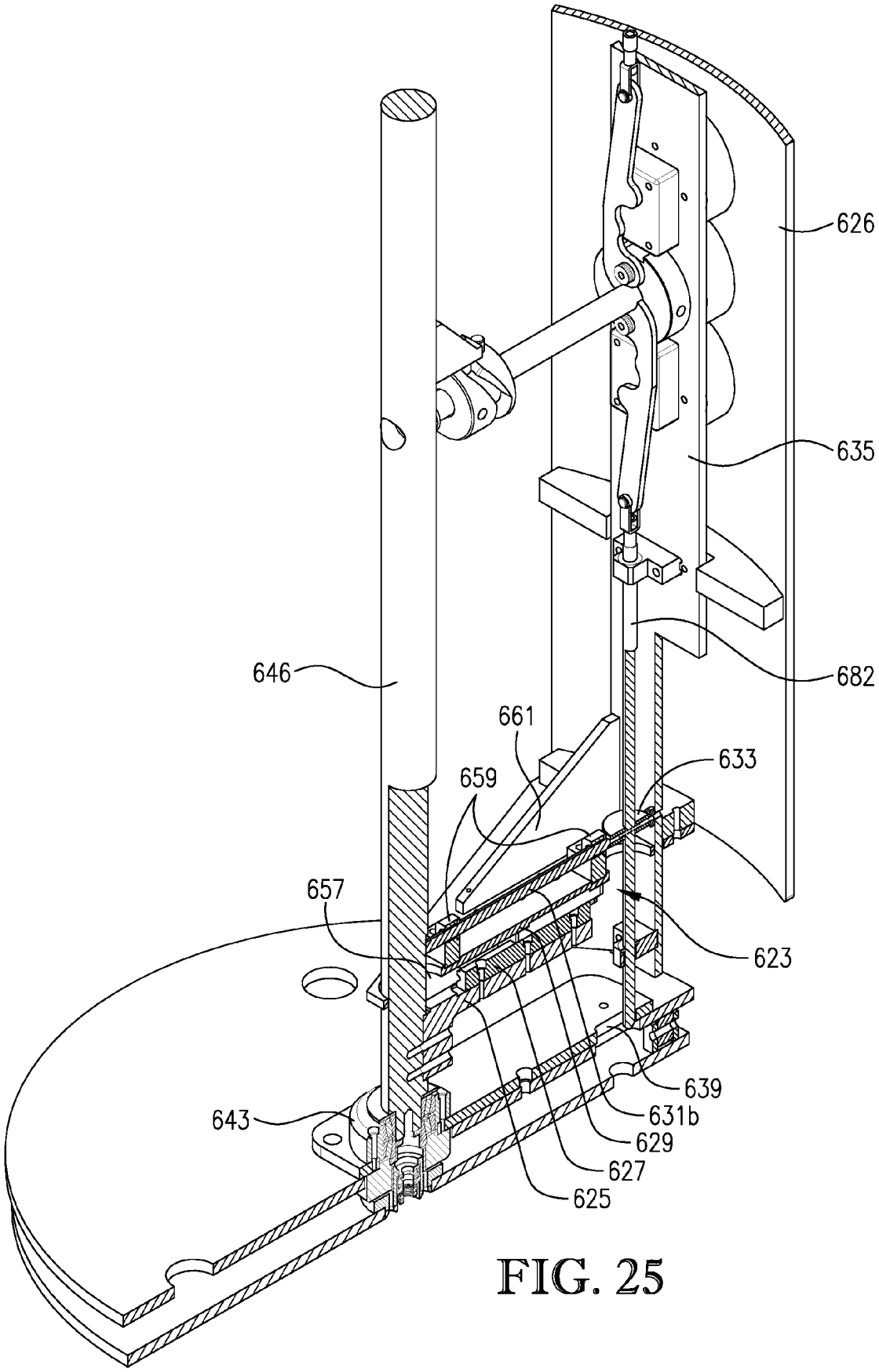
FIG. 25 is an enlarged partial isometric cut-away view of the lower door support assembly of the safe depicted in FIG. 22, particularly illustrating how the radial lock bar cooperates with a movable lock block on the upright locking bar to prevent the door from being forced inward while the door is locked.
Figure 26:
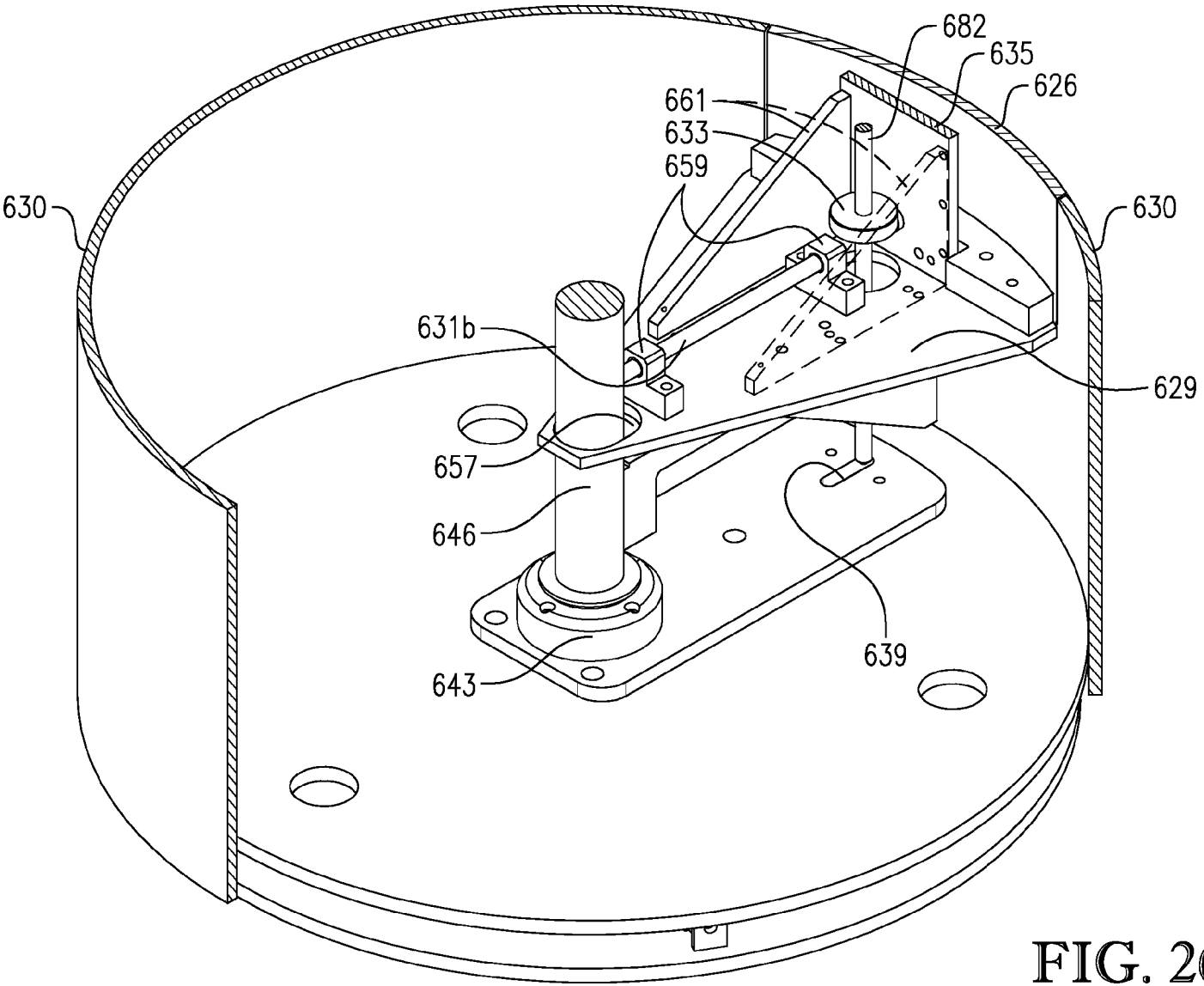
FIG. 26 is an enlarged partial isometric cut-away view of the lower door support assembly of the safe depicted in FIG. 22, particularly illustrating how the lock block moves out of contact with the radial lock bar when the upright locking bars are unlocked.

Referring again to FIG. 22, the safe 620 also includes upper and lower radial lock bars 631*a*, 631*b* located near the upper and lower door support assemblies 621*a* and 621*b*. FIGS. 24-26 illustrate more detail about the lower radial lock bar 631*b*. The lower radial lock bar 631*b* configuration will now be described with reference to FIGS. 24-26; however, is noted that the upper redial lock bar 631*a* operates in substantially the same manner as the lower radial lock bar 631*b*. Therefore, the following description should be taken as applying to both the upper and lower radial lock bars 631*a,b*.

As shown in FIGS. 24-26, the lower radial lock bar 631*b* extends in a substantially horizontal fashion between the door 626 and the central support post 646. One end of the lock bar 631*b* is positioned adjacent a flattened engagement surface 637 (FIG. 24) of the central support post 646. When the safe 620 is locked, as shown in FIG. 25, the opposite end of the lock bar 631*b* is aligned adjacent a lock block 633 that is coupled to the upright locking bar 682. As previously discussed, the upright locking bar 682 shifts up and down to lock and unlock the safe. When the lower end of upright locking bar 682 is received in a locking slot 639, as shown in FIGS. 24 and 25, the lock block 633 is vertically aligned with the radial lock bar 631*b*. Then the lower end of the upright locking bar 682 is retracted from the locking slot 639, as shown in FIG. 26, and the lock block 633 is positioned out of vertical alignment with the radial locking bar 631*b*. Thus, if a person were to try to force the bottom of the door 626 of the safe 620 inward toward the central support post 646 while the safe 620 was locked, the inward force applied to the lower part of the door would be transmitted to the central support post 646 via contact between the door back plate 635, the lock block 633, the radial lock bar 631*b*, and the engagement surface 629 of the post 646. However, when the safe is unlocked, the door 626 can be moved inward toward the central post 646 because the lock block 633 is not aligned for contact with the radial lock bar 631*b*.

As perhaps best illustrated in FIGS. 25 and 26, the radial lock bar 631*b* can be coupled to a lower door support plate 629 by a pair of lock bar supports 659. The lock bar supports 659 prevent vertical and lateral movement of the lock bar 631*b* relative to the door support plate 629, but permit linear radial movement of the lock bar 631*b* relative to the door support plate 629. When the door 626 is shifted inwardly toward the post 646, the lock bar 631*b* is "pushed" by post 646 and slides within the lock bar supports 659 so that the distance between the terminal end of the radial lock bar 631*b* and the upright locking bar 682 is reduced. When the door 626 is shifted outwardly away from the post 646 and towards its closed position, the lock bar 631*b* slides back away from the upright locking bar 682 to make room for the lock block 633 to be shifted between the door back plate 635 and the terminal end of the radial lock bar 631*b* when the door 626 is locked in its closed position.

In one embodiment, the end of the radial lock bar 631*b* that is positioned adjacent the post 646 is fixed to the post 646. In this configuration, when the door 626 is moved away from the post 646, the post 646 retains the radial lock bar 631*b* and allows the upright locking bar 682 to move away from the terminal end of the radial lock bar 631*b* a sufficient distance to allow for the lock block 633 to be shifted into vertical alignment with the terminal end of the radial lock bar 631*b*.

In an alternative embodiment, the end of the radial lock bar 631*b* that is positioned adjacent the post 646 is not attached to the post 646. In this configuration, lock block 633 is provided with an angled surface (not shown) that contacts the terminal end of the radial lock bar 631*b* when the upright locking bar 682 is shifted from the unlocked position to the locked position. This sloped surface of the lock block 633 causes the radial lock bar 631 to slide towards the central support post 646 as the upright locking bar 682 is shifted into the locked position. Once the upright locking bar 682 is in the lock position, the terminal end of the radial lock bar 631 is vertically aligned with a substantially vertical surface of the lock block 633. In such a configuration, the radial lock bar 631*b* may be considered "free floating," in that neither of its ends are rigidly coupled to another structure so that the radial lock bar 631*b* can be pushed back and forth by the post 646 and the sloped surface of the lock block 633 when the door 626 is shifted between the closed-locked position and the opened position.

Referring again to FIGS. 25-26, shifting of the door 626 is facilitated by a slide assembly 603 having a lower member 625 coupled to the post 646 and an upper member 627 coupled to the door 626. In the embodiment depicted in FIGS. 22-26, the upper member 627 of the slide assembly 603 is coupled to the door 626 via the door support plate 629 and a plurality of door support gussets 661. The lower and upper members 625 and 627 of the slide assembly 603 are slidably intercoupled with one another and permit radial translation of the door 626 relative to the post 646.

As perhaps best shown in FIGS. 25 and 26, the door support plate 629 defines an elongated post-receiving opening 657 through which the central support post 646 extends. When the door 626 is shifted relative to the central support post 646, the position of the post 646 within the post-receiving opening 657 changes. One advantage of the post-receiving opening 657 is that it allows the door support plate 629 to extend entirely around the post 646 so that when the door 626 is closed, if a prying force were applied to the outside of the door 626, the prying force would be transmitted from the door 626 to the post 646 via the door support plate 629. This makes it virtually impossible to pry the door 626 open from outside the safe 620.

FIGS. 27*a* and 27*b* depict the lower and upper gun supporting structures 700, 702, respectively, for a gun safe configured to hold 21 long guns. Such a safe would typically have a diameter between 26 and 34 inches. Preferably, a diameter of about 30 inches.

FIGS. 27*c* and 27*d* depict the lower and upper gun supporting structures 710. 712, respectively, for a gun safe configured to hold 10 long guns. Such a safe would typically have a diameter between 20 and 28 inches. Preferably, a diameter of about 24 inches.

The lower gun supporting structures 700, 710 of FIGS. 27*a* and 27*c* each define a plurality of gun-butt-receiving recesses 704, 714 for receiving and supporting the butt end of the guns. In one embodiment, these gun-butt-receiving recesses 704, 714 can be partly filled with a flexible, resilient cushioning material that helps inhibit movement of the guns when the gun supporting assembly is rotated in the safe. In a preferred embodiment, the gun-butt-receiving recesses 704, 714 can be partly filled with a memory foam material that conforms to the shape of the gun butt when the gun is placed therein, but returns to its original shape when the gun is removed from the recess.

The upper gun support structure 702 depicted in FIG. 27*b* includes an inner row of gun-barrel-receiving openings 706 and an outer row of gun-barrel-receiving openings/recesses 708. The upper gun support structure 712 depicted in FIG. 27*d* simply has one row of gun-barrel-receiving openings/recesses 716.

FIG. 28 illustrates a safe 800 with an alternative configuration for the gun supporting assembly 802 and the door 804. For the safe 800 illustrated in FIG. 28, the door 804 does not move relative to the gun supporting assembly 802. Rather, the door 804 is rigidly coupled to the gun supporting assembly 802 by a plurality of door supports 805. In order to move the door 804 relative to the safe housing 806 for opening and closing, the entire gun supporting assembly 802 and door 804 slide inwardly on upper and lower slides 808*a*, 808*b*. Once the door 804 is slid inwardly enough to clear the sidewall 810 of the housing 806, the door 804 and gun supporting assembly 802 can be rotated inside the housing 806 to provide access to the items in the safe 800.

The safe 800 depicted in FIG. 28 is locked by rotating a horizontal shaft 812 extending from the door 804 to the central vertical post 814 of the gun supporting structure 802. Rotating the horizontal shaft 812 causes extension or retraction of two upright locking bars 816*a*, 816*b* that are located within the hollow vertical post 814 of the gun supporting structure 802. This retraction of the locking bars 816*a*, 816*b* can be accomplished using a bevel gear 817 having a first section 819 on the rotatable shaft 812 and a second section 821 on the gun supporting assembly 802. The second section 821 of the bevel gear 817 can threadable engage internal locking bars 816*a*, 816*b* so then rotation of the second section 821 causes translation of the locking bars 816*a*, 816*b*. When these internal locking bars 816*a*, 816*b* are extended outwardly, they are received in lock openings 823*a*, 823*b* and lock the gun supporting structure 802 in its central position, thereby locking the door 804 in its closed position. When the internal locking bars 816*a*, 816*b* are retracted, the gun supporting assembly 802 and door 804 are free to slide inwardly and outwardly, and to be rotated when slid inwardly. FIG. 29 is an enlarged view of the bottom portion of the safe depicted in FIG. 28, particularly illustrating how the gun supporting structure slides inwardly when the door is opened.

As depicted in FIG. 30, the safe of FIG. 28 can include a plurality of guide wheels 818*a*, 818*b*, 818*c* for guiding rotation of the gun supporting assembly 802 within the safe housing 806. The guide wheels 818*a-c* can roll on a guide curb 820 when the gun supporting assembly 802 is rotated within the safe housing 806. The guide curb 820 helps the gun supporting assembly 802 to rotate smoothly within the safe housing and also helps align the door 804 for closing. FIG. 31 simply depicts an alternative configuration with a guide curb 822 that is spaced inwardly from the sidewall 810 of the safe, except for the portion that aligns the door 804 for closing.

In the embodiments of the present invention depicted in FIGS. 32 through 36, the door 900 of the safe 902 swings outwardly, but no external hinges or locks are used. FIGS. 32 though 34 illustrate the details of upper and lower internal locking mechanisms 904*a*, 904*b* used to lock the outwardly swinging door 900 in the closed position. Each internal locking mechanism 904*a,b* includes a rotatable rod 906 with a toothed gear 908 on the end of the rod 906. The toothed gear 908 on the rotatable rod 906 engages gear teeth 910*a* on the lower side of an upper locking bar 912*a* as well as gear teeth 910*b* on the upper side of a lower locking bar 912*b*. On the outside of both locking bars 912*a,b* are support guides 914, which maintain the teeth 910*a,b* the locking bars 912*a,b* in engagement with the teeth on the central gear 908. In operation, when the rotatable rod 906 is rotated in a first direction, the locking bars 912*a,b* extend outwardly past the perimeter of the door 900 to prevent opening of the door 900. Rotation of the rotatable rod 906 in a second opposite direction causes the locking bars 912*a,b* to retract back within the outer perimeter to permit opening of the door 900.

FIGS. 35 and 36 illustrate the use of an internal (invisible) hinge 920 to permit the door 900 to swing outwardly, while maintaining the hinge 920 completely within the housing of safe 902, thereby enhancing the security of the safe 902 by preventing access to the safe 902. The primary difference between the embodiments depicted in FIGS. 35 and 36 is that angle iron 922 is used around the internal perimeter of the door 900 in FIG. 35, while a flat bar 924 is used around the internal perimeter of the door 900 in FIG. 36. In one embodiment, the internal hinge 920 is an SOSS Model 220 Hinge Assembly, available from Universal Industrial Products, Inc. of Pioneer, Ohio.

In an embodiment of the present invention depicted in FIGS. 37 through 40, the safe 1000 includes a main safe body 1002 that is rotatable on a base 1004. The base 1004 also includes a locking mechanism 1006 that selectively prevents rotation of the main body 1002 of the safe 1000 on the base 1004. By having a lockable rotation base 1004, the main body 1002 of the safe 1000 can be rotated into and locked in a position where access to the door of the safe 1002 is difficult or impossible. This provides further protection against theft. For example, if the safe 1000 is located in a corner of a room, the safe 1000 could be locked in a position where the door faces the corner. This would make access to the door very difficult without moving the entire safe 1000. When access to the safe 1000 is desired by the owner, he or she simply unlocks the rotation base 1004 and rotates the main body 1002 of the safe 1000 to a position where access to the door is easily gained.

FIGS. 38 through 40 provide detail on the configuration of the base 1004 and how it works. Basically, the base 1004 includes a lower baseplate 1014 that rests on the floor/ground and an upper baseplate 1012 upon which the bottom of the sidewall 1008 of the main safe body rests. The floor 1010 of the main safe body is maintained above the upper baseplate 1012. The upper baseplate 1012 is able to be rotated relative to the lower baseplate 1014 through the use of multiple bearings/rollers 1020 and a central pivot 1018. A base sidewall 1016 is coupled to and extends upwardly from the lower baseplate 1014.

The locking mechanism 1006 is used to selectively restrict rotation of the upper baseplate 1012 relative to the lower baseplate 1014. The locking mechanism 1006 includes certain components that are coupled to the upper baseplate 1012 and certain components that are coupled to the lower baseplate 1014. The components of the locking mechanism 1006 that are coupled to the upper baseplate 1012 include the lock housing 1022 and the lock shaft 1034. The component of the locking mechanism 1006 that is coupled to the lower baseplate 1014 is the lock reinforcing plate 1024. The locking mechanism 1006 also includes a lock head 1026 that receives a key 1028 for releasing the lock head 1026 from the lock shaft 1034.

In order to lock the rotation base 1004, the lock head 1026 is inserted into a lock opening 1030 that is cooperatively defined by the base sidewall 1016, the lock reinforcing plate 1024, and the lock housing 1022. The lock head 1026 can only be inserted into the lock opening 1030 when the base 1004 is rotated into "home" position (shown in FIG. 39*b*). When the base is in home position, an optional stop 1032 located on the lock housing engages the lock reinforcing plate 1024 and prevents further rotation of the upper baseplate 1012. Once the lock head 1026 is inserted into the lock opening 1030, it can be secured in that position by turning and removing the key 1028 from the lock head 1026. Because the inserted lock head 1026 extends into an opening 1030 that is defined by both the lock reinforcing plate 1024 (which is fixed) and the lock housing 1022 (which is rotatable), no rotation of the main body 1002 of the safe 1000 is possible without shearing the lock head 1026 or severely damaging the safe 1000. In one embodiment, an additional stop structure (not shown) is attached to the upper baseplate 1012 at a location about 180 degrees from the location of the lock housing 1022. This additional stop structure contacts the lock reinforcing plate 1024 when the main body 1002 of the safe 1000 has been rotated about 180 degrees from home position, thereby preventing further rotation of the main body 1002 of the safe 1000 in that direction.

The lock shaft 1034, lock head 1026, and key 1028 can be provided by any one of a number of commercially available locks such as, for example, the MASTERLOCK™ 1480DAT hitch lock.

In one embodiment of this invention, the safe is coated, inside and/or out, with a flame retardant, heat resistant paint, and/or heat insulating paint. For example, the safe can be coated with CEASEFIRE™ Superior type coating. An alternative coating is known under the commercial designation FLAMECONTROL™.

The preferred forms of the invention described above are to be used as illustration only, and should not be utilized in a limiting sense in interpreting the scope of the present invention. Obvious modifications to the exemplary embodiments, as hereinabove set forth, could be readily made by those skilled in the art without departing from the spirit of the present invention.

The inventors hereby state their intent to rely on the Doctrine of Equivalents to determine and assess the reasonably fair scope of the present invention as pertains to any apparatus not materially departing from but outside the literal scope of the invention as set forth in the following claims.

What is claimed is:

1. A secure enclosure comprising:

a housing;

a door coupled to the housing and shiftable between a closed position and an open position;

a door locking system configured to selectively lock and unlock the door in the closed position;

a door shifting system configured to shift the door into and out of the closed position, wherein the door shifting system comprises a rotating member configured to be actuated from outside the enclosure, wherein the rotating member is operatively coupled to the door shifting system and the door locking system in a manner such that rotation of the rotating member in one direction has the dual effect of unlocking the locking system and shifting the door out of the closed position.

2. The enclosure according to claim 1, wherein rotation of the rotating member in an opposite direction of said one direction has the dual effect of shifting the door into the closed position and locking the locking system.

3. The enclosure according to claim 1, wherein the door locking system comprises a pair of oppositely extending locking bars shiftably coupled to the door and a corresponding pair of locking bar receivers coupled to the housing, wherein the receivers are configured to receive respective ends of the locking bars to thereby lock the door in the closed position.

4. The enclosure according to claim 3, wherein the locking bars extend outwardly from the perimeter of the door when the ends of the locking bars are in the receivers.

5. The enclosure according to claim 3, wherein the door locking system comprises a pair of transfer arms coupled to and extending between a respective locking bar and the rotating member, wherein the transfer arms are operable to transfer motion from the rotating member to the locking bars.

6. The enclosure according to claim 5, wherein each transfer arm has a first end that is pivotally coupled to the rotating member at an eccentric location and a second end that is pivotally coupled to a respective locking bar, wherein the transfer arms are operable to convert rotational motion of the rotating member into linear motion of the locking bars.

7. The enclosure according to claim 1, wherein the door locking system comprises at least two independent locks that both must be unlocked prior to shifting the door out of the closed position.

8. The enclosure according to claim 7, wherein each of the independent locks is a lock type selected from the group consisting of combination lock, key-operated lock, electronic touch pad lock, mechanical touch pad lock, remote control lock, fingerprint lock, and retinal scan lock.

9. The enclosure according to claim 7, wherein one of said independent locks is a combination lock and another of said independent locks is a key-operated lock.

10. The enclosure according to claim 1, wherein the door shifting system comprises an upright support member rotatably coupled to the housing.

11. The enclosure according to claim 10, wherein the door shifting system comprises a cam and a follower, wherein one of the cam and follower is coupled to the upright support member and the other of the cam and follower is coupled to the rotating member for rotation therewith, wherein the cam and follower cooperate to shift the door relative to the support member, into or out of the closed position, when the rotatable member is turned.

12. The enclosure according to claim 10, wherein said door shifting system comprises a door supporting assembly for supporting the door on the upright support member, wherein the door supporting assembly comprises a pair of slidably intercoupled attachment elements, wherein one of the attachment elements is coupled to the upright support member and the other of the attachment elements is coupled to the door.

13. The enclosure according to claim 10, further comprising an upper radial lock bar located near a top of the door and a lower radial lock bar located near a bottom of the door, wherein each of the radial lock bars extends substantially horizontally between the upright support member and the door so that when the door is closed and the locking system is locked the radial lock bars prevent the door from being forced inward toward the upright support member.

14. The enclosure according to claim 13, wherein the radial lock bars are not rigidly coupled to the door and are not rigidly coupled to the upright support member.

15. The enclosure according to claim 13, wherein the door locking system comprises upper and lower upright locking bars shiftably coupled to the door and a corresponding pair of upper and lower locking bar receivers coupled to or formed in the housing, wherein the upper and lower receivers are configured to receive respective ends of the upper and lower locking bars to thereby lock the door in the closed position, wherein said door locking system comprises a upper and lower lock blocks coupled to the upper and lower upright locking bars respectively, wherein when the door locking system is locked the upper and lower lock blocks are vertically aligned with the upper and lower radial lock bars respectively, wherein when the door locking system is unlocked the upper and lower lock blocks are not vertically aligned with the upper and lower radial lock bars respectively.

16. The enclosure according to claim 10, wherein said enclosure is a gun safe, wherein the enclosure further comprises a gun support assembly coupled to the upright support member for rotation therewith, wherein the gun support assembly includes a lower support member and an upper support member, wherein the lower support member includes an outer group of gun-butt-receiving recesses and an inner group of gun-butt-receiving recesses, wherein the upper support member includes an outer group of gun-barrel-receiving openings and an inner group of gun-barrel-receiving openings.

17. The enclosure according to claim 10, wherein said door shifting system comprises an automatic mechanical actuator for rotating the upright support member relative to the housing.

18. The enclosure according to claim 17, wherein the automatic mechanical actuator is an electric motor.

19. The enclosure according to claim 1, wherein the door shifting system comprises a manually rotatable handle for causing rotation of the rotating member.

20. The enclosure according to claim 19, wherein the rotatable handle is substantially flush with the outer surface of the door when the door is locked.

21. The enclosure according to claim 19, wherein the rotatable handle includes a plurality of finger holes for facilitating rotation by a human hand.

22. The enclosure according to claim 19, wherein the housing comprises a substantially cylindrical sidewall, wherein the outer surface of the door and the outer surface of the rotatable handle both have a radius of curvature substantially corresponding to the curvature of the sidewall.

23. The enclosure according to claim 1, wherein the door shifting system comprises an automatic mechanical actuator for causing rotation of the rotating member, wherein the mechanical actuator is disposed within the enclosure and is actuated from outside the enclosure.

24. The enclosure according to claim 23, wherein the automatic mechanical actuator is an electric motor.

25. The enclosure according to claim 1, wherein the door shifting system is configured to open and close the door without the use of exposed hinges.

* * * * *